US008453791B2

(12) United States Patent
Wakatsuki et al.

(10) Patent No.: US 8,453,791 B2
(45) Date of Patent: Jun. 4, 2013

(54) EXHAUST PIPE PART AND EXHAUST APPARATUS FOR INTERNAL COMBUSTION ENGINE

(75) Inventors: Kazutoshi Wakatsuki, Toyota (JP); Nakaya Takagaki, Toyota (JP); Hideyuki Komitsu, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/391,581

(22) PCT Filed: Sep. 24, 2009

(86) PCT No.: PCT/JP2009/004799

§ 371 (c)(1),
(2), (4) Date: Feb. 21, 2012

(87) PCT Pub. No.: WO2011/036700

PCT Pub. Date: Mar. 31, 2011

(65) Prior Publication Data

US 2012/0168245 A1 Jul. 5, 2012

(51) Int. Cl.
*F01N 13/08* (2010.01)

(52) U.S. Cl.
USPC ..... 181/227; 181/228

(58) Field of Classification Search
USPC ..... 181/227, 228, 247, 248
See application file for complete search history.

(56) References Cited

U.S. PATENT DOCUMENTS

| | | | | | |
|---|---|---|---|---|---|
| 3,112,007 | A | * | 11/1963 | Ludlow et al. | 181/227 |
| 3,429,397 | A | * | 2/1969 | Case | 181/227 |
| 3,884,323 | A | * | 5/1975 | Kunz, Jr. | 181/247 |
| 4,966,253 | A | * | 10/1990 | Stephens et al. | 181/227 |
| 5,449,866 | A | * | 9/1995 | Moss | 181/228 |
| 5,881,555 | A | * | 3/1999 | Jaeger | 60/310 |
| 7,669,693 | B2 | | 3/2010 | Yamaguchi et al. | |
| 2005/0126850 | A1 | | 6/2005 | Yamaguchi et al. | |
| 2010/0300799 | A1 | | 12/2010 | Matsueda et al. | |

FOREIGN PATENT DOCUMENTS

| | | |
|---|---|---|
| JP | U-55-156203 | 11/1980 |
| JP | U-61-194726 | 12/1986 |
| JP | U-63-82022 | 5/1988 |
| JP | U-1-105714 | 7/1989 |
| JP | A-3-3912 | 1/1991 |

(Continued)

OTHER PUBLICATIONS

Dec. 22, 2009 International Search Report issued in PCT/JP2009/004799 (with English-language translation).

*Primary Examiner* — Jeremy Luks
(74) *Attorney, Agent, or Firm* — Oliff & Berridge, PLC

(57) ABSTRACT

A tail pipe part includes a tail pipe to constitute part of the tail pipe, and has a hollow member connected with the tail pipe in axial alignment with the tail pipe to be positioned within an area covering a node portion in a sound pressure distribution of an air column resonance caused in the tail pipe, and a short pipe included in the hollow member and having a predetermined length to extend in the axial direction of the tail pipe, the short pipe having an open end at the upstream end thereof and a closed end at the downstream end thereof, the closed end being constituted by a bottom plate positioned at almost the same position as that of the node portion in the sound pressure distribution of a standing wave formed by the air column resonance caused in the tail pipe.

13 Claims, 34 Drawing Sheets

FOREIGN PATENT DOCUMENTS

| | | |
|---|---|---|
| JP | A-2002-303117 | 10/2002 |
| JP | A-2004-293456 | 10/2004 |
| JP | A-2005-171933 | 6/2005 |
| JP | A-2006-46121 | 2/2006 |
| JP | A-2009-62881 | 3/2009 |

* cited by examiner

EXHAUST PIPE PART AND EXHAUST APPARATUS FOR INTERNAL COMBUSTION ENGINE

TECHNICAL FIELD

This invention relates to an exhaust pipe part and an exhaust apparatus for an internal combustion engine, and more particularly to an exhaust pipe part and an exhaust apparatus for an internal combustion engine for reducing exhaust gas noises caused by an air column resonance in an exhaust pipe provided at the most downstream side in the discharging direction of an exhaust gas.

BACKGROUND OF TECHNOLOGY

As an exhaust gas apparatus of an internal combustion engine to be used by an automotive vehicle and other vehicles, there is known an exhaust gas apparatus as shown in FIG. 32 (for example see Patent Document 1). In FIG. 32, the known exhaust gas apparatus 4 is constructed to allow an exhaust gas to be introduced therein after the exhaust gas exhausted from an engine 1 serving as an internal combustion engine passes through an exhaust manifold 2 and is then purified by a catalytic converter 3.

The exhaust gas apparatus 4 is constituted by a front pipe 5 connected to the catalytic converter 3, a center pipe 6 connected to the front pipe 5, a main muffler 7 connected to the center pipe 6 and serving as a sound deadening device, a tail pipe 8 connected to the main muffler 7, and a sub-muffler 9 connected to the tail pipe 8.

The main muffler 7 has an expansion chamber for introducing therein and expanding the exhaust gas to mute the sound of the exhaust gas, and a resonance chamber for muting the sound of the exhaust gas having a specified frequency under the influence of Helmholtz resonator effect. More specifically, the resonance chamber can tune its resonance frequency to the low frequency side by making large the volume of the resonance chamber or otherwise by making long the projecting length of the center pipe 6, while can tune its resonance frequency to the high frequency side by making small the volume of the resonance chamber or otherwise by making short the projecting length of the center pipe 6.

The sub-muffler 9 is adapted to reduce the sound pressure when the column air resonance is generated in the tail pipe 8 in response to the pipe length of the tail pipe 8 by the pulsation of the exhaust gas during the operation of the engine 1.

In general, the tail pipe having an upstream opening end and a downstream opening end at the respective upstream and downstream sides of the exhaustion direction of the exhaust gas is subjected to incident waves caused by being reflected with the pulsation of the exhaust gas during the operation of the engine at the upstream opening end and the downstream opening end, thereby causing an air column resonance with a wavelength. The air column resonance has a basic component of a frequency with a half wavelength equal to the pipe length of the tail pipe, and thus has a wavelength several times the half wavelength.

For example, taking an example in which the tail pipe 8 having no sub-muffler 9 extends backwardly from the main muffler 7, as shown in FIG. 33, the wavelength λ1 of the air column resonance of a basic vibration (primary component) is roughly double the pipe length L of the tail pipe 8, while the wavelength λ2 of the air column resonance of the secondary component is roughly one time the pipe length L of the tail pipe 8. Therefore, the tail pipe 8 has therein standing waves having respective node portions of sound pressures at the upstream opening end 8*a* and the downstream opening end 8*b*.

The air column resonance frequency "fm" of the tail pipe 8 is given by the following equation (1).

$$fm(c/2L)\times m \quad (1)$$

c: sound speed, L: pipe length of tail pipe, m: degree

As will be obvious from the above equation (1), it is known that the longer the pipe length L of the tail pipe 8, the more the air column resonance frequency "fm" is transferred to the low frequency area with the rotation number of engine 1 being low.

It is further known that as shown in FIG. 34, the frequency of the exhaust gas pulsation of the engine 1 is increased as the rotation number of the engine 1 is increased, and the sound pressure levels (dB) of the exhaust gas sound are raised with the primary component f1 and the second component f2 of the exhaust gas sound caused by the air column resonance in response to the rotation number of the engine 1.

Therefore, in the case of using a tail pipe 8 having a long pipe length (for example, the pipe length of the tail pipe 8 is more than or equal to 1.5 m), there is occasionally generated such an air column resonance in the normal rotation area (2000 rp~5000 rpm) having a low engine rotation number, thereby causing exhaust gas noises to be increased and thus giving unpleasant feelings to a driver.

In particular, as shown in FIG. 32, the peak (the width of the abdominal portion in the sound pressure distribution) of the sound pressure for the primary component f1 of the air column resonance is larger than the peak of the sound pressure for the secondary component f2 of the air column resonance, so that there is generated in the normal rotation area of the engine unpleasant noises called muffled sounds which are a cause for the exhaust gas noises to be deteriorated.

For this reason, in the case of the pipe length of the tail pipe 8 being long, the sub-muffler 9 smaller in capacity than the main muffler 7 is provided at the abdominal portion of the standing wave high in the sound pressure level, and at the optimum position among the respective abdominal portions of the primary component f1 and the secondary component f2 of the exhaust gas sound caused by the air column resonance as shown in FIG. 32, so that the exhaust gas noises can be suppressed in the normal rotation area of the engine to prevent the unpleasant feelings from be given to the driver.

PRIOR ART TECHNOLOGY DOCUMENT

Patent Documents

Patent Publication 1: No. 2006-46121

SUMMARY OF INVENTION

Problems to be Solved by Invention

However, the conventional exhaust gas apparatus for the engine 1 encounters such a problem that the conventional exhaust gas apparatus is required to be provided with a sub-muffler 9 on the tail pipe 8 in order to suppress the sound pressure level of the air column resonance, thereby resulting in increasing the weight and production cost of the exhaust apparatus 4 by providing the sub-muffler 9.

Further, it may be considered that only the main muffler 7 is used in lieu of the sub-muffler 9 to reduce the air column resonance of the tail pipe 8 in the resonance chamber of the main muffler 7. In this case, it is necessary to have the volume of the resonance chamber of the main muffler 7 enlarged. For this reason, the main muffler 7 is required to be made large in size, thereby resulting in not only the increased weight of the exhaust apparatus 4 but also the increased production cost of the exhaust apparatus 4 in response to the main muffler 7 made large in size.

The present invention has been made to solve the previously mentioned problems, and has an object to provide an exhaust pipe part and an exhaust apparatus which can make unnecessary the muffler used in the conventional exhaust apparatus, and reduce the size of a sound deadening device provided on the one end portion of the exhaust pipe, as well as can reduce the weight and the production cost of the exhaust apparatus.

Means for Solving the Problem

To achieve the previously mentioned object, (1) the exhaust pipe part according to the present invention to be attached to an exhaust pipe and constituting part of the exhaust pipe, the exhaust pipe having at one end portion an upstream open end connected with a sound deadening device positioned at an upstream side of exhaust gas discharged from an internal combustion engine, and at the other end portion a downstream open end to allow the exhaust gas discharged to the atmosphere, the exhaust pipe part comprising: a hollow member to be connected with the exhaust pipe in axial alignment with the exhaust pipe to be positioned within an area covering a node portion in a sound pressure distribution of an air column resonance caused in the exhaust pipe, and a short pipe provided in the hollow member and having a predetermined length to extend in the axial direction of the exhaust pipe, the short pipe having a closed end at an axial one end thereof and an open end at the axial other end thereof, the closed end being positioned at almost the same position as that of the node portion in the sound pressure distribution of a standing wave formed by the air column resonance caused in the exhaust pipe, the standing wave of the air column resonance having a wave length $\lambda$, and the short pipe being set to have a length less than or equal to $\frac{1}{8}\lambda$.

The exhaust pipe provided with the exhaust pipe part thus constructed can accumulate the potential energy of the air column resonance in the short pipe, and distribute the potential energy in the exhaust pipe into the short pipe and the exhaust pipe with the short pipe removed therefrom at the position of the node portion of the sound pressure distribution when the air column resonance is caused in the exhaust pipe. The system of the air column resonance caused has dynamic energy which is represented by the addition of kinetic energy and potential energy, and the dynamic energy is preserved.

The position of the node portion of the sound pressure distribution allows the sound pressure to have the minimum value, while allowing the particle speed to have the maximum value. This means that the potential energy of the air column resonance in the exhaust pipe can be accumulated in the short pipe provided at the position low in sound pressure, and thus is by no means discharged to the outside of the exhaust pipe.

For this reason, the potential energy in the exhaust pipe can be distributed into the potential energy in the short pipe and the potential energy in the exhaust pipe with the short pipe removed therefrom, so that only the potential energy in the exhaust pipe with the short pipe removed therefrom can be discharged to the outside of the exhaust pipe, thereby making it possible to lower the peak of the sound pressure and to reduce the sound pressure level. It is therefore possible to reduce the exhaust gas noises.

On the other hand, the hollow member has therein a short pipe having a predetermined length and extending in the axial direction of the exhaust pipe, so that the exhaust passage throttled in the hollow member can raise the particle speed at the position of the node portion of the sound pressure distribution where the particle speed of the standing wave of the air column resonance is at the maximum value.

Although the potential energy of the air column resonance in the exhaust pipe is distributed into the potential energy in the short pipe and the potential energy in the exhaust pipe with the short pipe removed therefrom, the potential energy is not varied as a whole, however, the kinetic energy can drastically be increased, and thus the dynamic energy can also be increased. For this reason, the exhaust pipe can be lengthened in a pseudo form, thereby lowering the frequency of the air column resonance to the frequency of the air column resonance equal to the frequency of the air column resonance caused in the exhaust pipe having a longer length.

Further, if the exhaust pipe is lengthened in the pseudo form, the potential energy in the exhaust pipe excluding the potential energy accumulated in the short pipe is distributed in the whole of the exhaust pipe only by the lengthened portion. This means that, from the standpoint of the dynamic energy, the exhaust pipe lengthened in the pseudo form is equivalent to the exhaust pipe slender in inner diameter, thereby making it possible to additionally reduce the peak of the sound pressure of the air column resonance as well as to additionally reduce the level of the sound pressure of the air column resonance.

As a consequence, the exhaust noises can drastically be reduced. Further, the exhaust apparatus provided with the exhaust pipe part thus constructed in addition to the exhaust pipe and the sound deadening device can make unnecessary the muffler used in the conventional apparatus, and make small in size the sound deadening device mounted on the part of the exhaust pipe. Moreover, the above exhaust apparatus can reduce the weight and the production cost thereof.

In particular, the standing wave of the air column resonance has a wave length $\lambda$, and the short pipe is set to have a length less than or equal to $\frac{1}{8}\lambda$, so that the short pipe can be positioned at the position where the standing wave of the air column resonance has a large particle speed, thereby making it possible to effectively enlarge the kinetic energy of the exhaust gas in the exhaust pipe with respect to the reduction amount of the potential energy.

To achieve the previously mentioned object, (2) the exhaust pipe part according to the present invention to be attached to an exhaust pipe and constituting part of the exhaust pipe, the exhaust pipe having at one end portion an upstream open end connected with a sound deadening device positioned at an upstream side of exhaust gas discharged from an internal combustion engine, and at the other end portion a downstream open end to allow the exhaust gas discharged to the atmosphere, comprising: a hollow member to be connected with the exhaust pipe in axial alignment with the exhaust pipe to be positioned within an area covering a node portion in a sound pressure distribution of an air column resonance caused in the exhaust pipe, and a short pipe provided in the hollow member and having a predetermined length to extend in the axial direction of the exhaust pipe, the short pipe having a closed end at an axial one end thereof and an open end at the axial other end thereof, the closed end being positioned at almost the same position as that of the node portion in the sound pressure distribution of a standing wave formed by the air column resonance caused in the exhaust pipe, the short pipe having a length less than or equal to $\frac{1}{4}$ the length of the exhaust pipe. The above construction (2) can obtain an advantageous effect the same as that of the above construction (1).

According to the present invention, the construction especially features the short pipe has a length less than or equal to ¼ the length of the exhaust pipe, so that the short pipe can be positioned at the position where the standing wave of the air column resonance has a large particle speed, thereby making it possible to effectively enlarge the kinetic energy of the exhaust gas in the exhaust pipe with respect to the reduction amount of the potential energy.

In the exhaust pipe part according to the present invention as set forth in the above item (1) or (2), (3) the short pipe and the hollow member form therebetween an exhaust passage throttled in such a manner that the volume per unit length of the exhaust passage between the short pipe and the hollow member is smaller than the volume per unit length of the exhaust passage of the exhaust pipe.

The exhaust pipe part thus constructed with exhaust passage throttled in the hollow member can raise the particle speed at the position of the node portion of the sound pressure distribution where the particle speed of the standing wave of the air column resonance is at the maximum value, and the kinetic energy can drastically be increased. For this reason, the kinetic energy drastically increased makes it possible for the exhaust pipe to be lengthened in a pseudo form, so that the frequency of the air column resonance can be lowered to the frequency of the air column resonance equal to the frequency of the air column resonance caused in the exhaust pipe having a longer length.

Further, if the exhaust pipe is lengthened in the pseudo form, the potential energy in the exhaust pipe excluding the potential energy accumulated in the short pipe is distributed in the whole of the exhaust pipe only by the lengthened portion. This means that, from the standpoint of the dynamic energy, the exhaust pipe lengthened in the pseudo form is equivalent to the exhaust pipe slender in inner diameter, thereby making it possible to additionally reduce the peak of the sound pressure of the air column resonance as well as to additionally reduce the level of the sound pressure of the air column resonance.

In the exhaust pipe part according to the present invention as set forth in the above items (1) to (3), (4) the hollow member has an inner diameter almost the same as the inner diameter of the exhaust pipe.

The exhaust pipe provided with the exhaust pipe part has the hollow member which is constructed to have the inner diameter the same as that of the exhaust pipe, viz., the straight pipe is connected with the exhaust pipe part having the short pipe, so that the volume per unit length of the exhaust passage of the hollow member is reduced to be smaller than the volume per unit length of the exhaust passage of the exhaust pipe to enable the exhaust passage between the short pipe and the hollow member to be throttled, thereby making it possible to raise the particle speed at the node portion of the sound pressure distribution where the particle speed is at the maximum level.

In the exhaust pipe part according to the present invention as set forth in the above items (1) to (4), (5) the hollow member is provided on at least one of the one end portion and the other end portion of the exhaust pipe to have the axial one end of the hollow member constitute at least one of the upstream open end and the downstream open end of the exhaust pipe.

By the above construction, the exhaust pipe provided with the exhaust pipe part is constructed to have one end portion or the other end portion constituted by the exhaust pipe part which thus constitutes the upstream open end portion or the downstream open end portion of the exhaust pipe positioned at the node portion of the sound pressure distribution of the standing wave of the air column resonance. The exhaust pipe provided with the exhaust pipe part makes it possible to reliably reduce the sound pressure of the primary component which is at the maximum value in the peak of the sound pressure of the air column resonance, and to lower the frequency of the air column resonance of the primary component to the frequency of the air column resonance equal to the frequency of the air column resonance caused in the exhaust pipe having a longer length. As a result, the exhaust noises can even more drastically be reduced.

Additionally, the peak of the secondary component or more basing the primary component of the air column resonance can also be reduced, thereby making it possible to even more reduce the exhaust gas noises in the normal rotation area of the internal combustion engine.

In the exhaust pipe part according to the present invention as set forth in the above items (1) to (5), (6) the short pipe has a size set in such a manner that the volume of the exhaust passage of the hollow member having the short pipe is reduced by a volume reduction amount from the whole volume of the exhaust passage of the exhaust pipe having no short pipe, the volume reduction amount being no less than 2.5%.

By the above construction, the size of the short pipe is set in such a manner that the volume reduction amount reduced from the whole volume of the exhaust passage is no less than 2.5%. The results of the speaker shaking test conducted with the exhaust pipe thus constructed find that the exhaust pipe provided with the exhaust pipe part makes it possible to lower the frequency of the air column resonance to the frequency of the air column resonance equal to the frequency of the air column resonance caused in the exhaust pipe having a longer length, and to reduce the peak of the sound pressure.

In the exhaust pipe part according to the present invention as set forth in the above items (1) to (6), (7) the closed end of the short pipe is formed by being bent from the axial one end of the hollow member toward the center axis of the exhaust pipe, the short pipe having an annular member bent from the closed end of the short pipe toward the axial other end of the hollow member to extend in parallel with the hollow member.

By the above construction, the exhaust pipe provided with the exhaust pipe part can be constructed to enable the short pipe to be easily formed by bending the axially one portion of the hollow member, thereby making it possible to reduce not only the production cost of the hollow member but also the production cost of the exhaust pipe.

In the exhaust pipe part according to the present invention as set forth in the above items (1) to (7), (8) the hollow member is provided at the one end portion of the exhaust pipe, the short pipe having cross-sectional areas at the axial one end thereof and at the axial other end thereof, the cross-sectional area of the short pipe at the axial one end thereof is smaller the cross-sectional area of the short pipe at the axial other end thereof.

By the above construction, the exhaust pipe provided with the exhaust pipe part can be constructed to enable the exhaust passage near the upstream end in the exhaust gas direction in the hollow member to be larger than the exhaust passage near the downstream end in the exhaust gas direction in the hollow member, thereby making it possible to prevent the short pipe from working to resist the flow of the exhaust gas, and thus to prevent the back pressure of the exhaust gas flowing in the exhaust pipe from being raised. Further, the exhaust provided with the exhaust pipe part can rectify the exhaust gas from the outer peripheral surface of the upstream portion of the short pipe to the outer peripheral surface of the downstream portion of the short pipe, thereby making it possible to prevent the turbulence flow of the exhaust gas from being caused, and thus to prevent the gas flow noises from being generated.

In the exhaust pipe part according to the present invention as set forth in the above items (1) to (8), (9) the hollow member is provided at the other end portion of the exhaust pipe, the short pipe having cross-sectional areas at the axial one end thereof and at the axial other end thereof, the cross-sectional area of the short pipe at the axial one end thereof is smaller than the cross-sectional area of the short pipe at the axial other end thereof.

By the above construction, the exhaust pipe provided with the exhaust pipe part can be constructed to enable the short pipe to be positioned at the position approximately the same as the position of the node portion of the sound pressure distribution of the standing wave of the air column resonance and to have the cross-sectional area at the axially one end of the short pipe larger than the cross-sectional area at the axially other end of the short pipe, so that the particle speed of the standing wave of the air column resonance can be more even increased, thereby making it possible to more effectively enlarge the kinetic energy of the exhaust gas.

In the exhaust pipe part according to the present invention as set forth in the above items (1) to (9), (10) the short plate has a bottom plate forming the closed end and constituted by an on-off valve, the on-off valve being opened when the flow amount of the exhaust gas flowing in the short pipe is over a predetermined flow amount.

By the above construction, the exhaust pipe provided with the exhaust pipe part can be constructed to enable the bottom plate of the short pipe to be constituted for closing the on-off valve at the low rotation time of the internal combustion engine having a relatively small amount of exhaust gas, thereby making it possible to accumulate the potential energy in the short pipe.

Further, the exhaust pipe provided with the exhaust pipe part can open the on-off valve to discharge the exhaust gas to the outside through the short pipe, thereby making it possible to prevent the back pressure of the exhaust gas from being raised at the time of the high rotation time of the internal combustion engine, and thus to prevent the exhaust property from being lowered.

In the exhaust pipe part according to the present invention as set forth in the above items (1) to (10), (11) which the inner diameter of the hollow member is expanded to be larger than the inner diameter of the exhaust pipe.

By the above construction, the exhaust pipe provided with the exhaust pipe part is expanded to have an expanded diameter portion in such a manner that the cross-sectional area of the exhaust passage of the exhaust pipe becomes the same as the cross-sectional area of the exhaust passage of the hollow member. In this case, the potential energy in the exhaust pipe can be distributed into the potential energy in the short pipe and the energy in the exhaust pipe with the short pipe removed therefrom, thereby making it possible to discharge only the energy in the exhaust pipe with the short pipe removed therefrom to the outside, and thus to lower the peak of the sound pressure to reduce the exhaust gas noises.

Further, the exhaust pipe provided with the exhaust pipe part is constructed to have the hollow member expanded in such a manner that the volume per unit length of the hollow member with respect to the volume per unit length of the exhaust pipe is decreased. In this case, the exhaust passage in the hollow member can be throttled, and thus the potential energy in the exhaust pipe can be distributed to lower the peak of the sound pressure. In addition of this advantageous effect, the particle speed can be raised at the position of the node portion of the sound pressure distribution where the particle speed of the standing wave of the air column resonance is at the maximum level. Moreover, the exhaust pipe can be lengthened in a pseudo form to have the frequency of the air column resonance of the exhaust pipe lowered to the frequency of the air column resonance equal to the frequency of the air column resonance caused in the exhaust pipe having a long length. Further, it is possible to additionally lower the peak of the sound pressure of the air column resonance.

An exhaust apparatus of an internal combustion engine provided with an exhaust pipe having at one end portion an upstream open end connected with a sound deadening device positioned at an upstream side of exhaust gas discharged from an internal combustion engine, and at the other end portion a downstream open end to allow the exhaust gas to be discharged to the atmosphere, the exhaust pipe having an exhaust pipe part as set forth in any one of claims 1 to 11.

By the above construction, the exhaust pipe can distribute the potential energy in the exhaust pipe into the potential energy in the short pipe and the energy in the exhaust pipe with the short pipe removed therefrom, thereby making it possible to discharge only the energy in the exhaust pipe with the short pipe removed therefrom to the outside, and thus to lower the peak of the sound pressure. As a consequence, it is possible to reduce the exhaust noises.

Further, the exhaust pipe according to the present invention can be lengthened in a pseudo form to have the frequency of the air column resonance of the exhaust pipe lowered to the frequency of the air column resonance equal to the frequency of the air column resonance caused in the exhaust pipe having a long length. Further, the potential energy can be distributed in the whole of the exhaust pipe by the lengthened portion of the exhaust pipe, thereby making it possible for the inner diameter of the exhaust pipe to be made slender in the pseudo form. For this reason, it is possible to additionally lower the peak of the sound pressure of the air column resonance and additionally reduce the sound pressure level of the air column resonance.

As a consequence, the exhaust noises can drastically be reduced. Further, the exhaust apparatus provided with the exhaust pipe part thus constructed in addition to the exhaust pipe and the sound deadening device can make unnecessary the muffler used in the conventional apparatus, and make small in size the sound deadening device mounted on the part of the exhaust pipe. Moreover, the above exhaust apparatus can reduce the weight and the production cost thereof.

In the exhaust pipe part according to the present invention as set forth in the above items (12), (13) the hollow member are integrally formed with the exhaust pipe.

By the above construction, the exhaust pipe according to the present invention has no need to separately produce the exhaust pipe and the exhaust pipe part, and then to assemble the exhaust pipe part with the exhaust pipe, thereby making it possible to facilitate the production of the exhaust pipe as well as to reduce the production cost of the exhaust pipe.

EFFECTS OF INVENTION

The present invention can provide an exhaust pipe part and an exhaust apparatus for the internal combustion engine which enables to make unnecessary a muffler used in the conventional exhaust apparatus and to make small in size a sound deadening device provided in the one end portion of an exhaust pipe and to reduce the exhaust gas noises. In addition, the exhaust pipe part and the exhaust apparatus according to the present invention can reduce the weight of the exhaust apparatus, and the production cost of the exhaust apparatus.

EMBODIMENT FOR CARRYING OUT INVENTION

Figure 1:
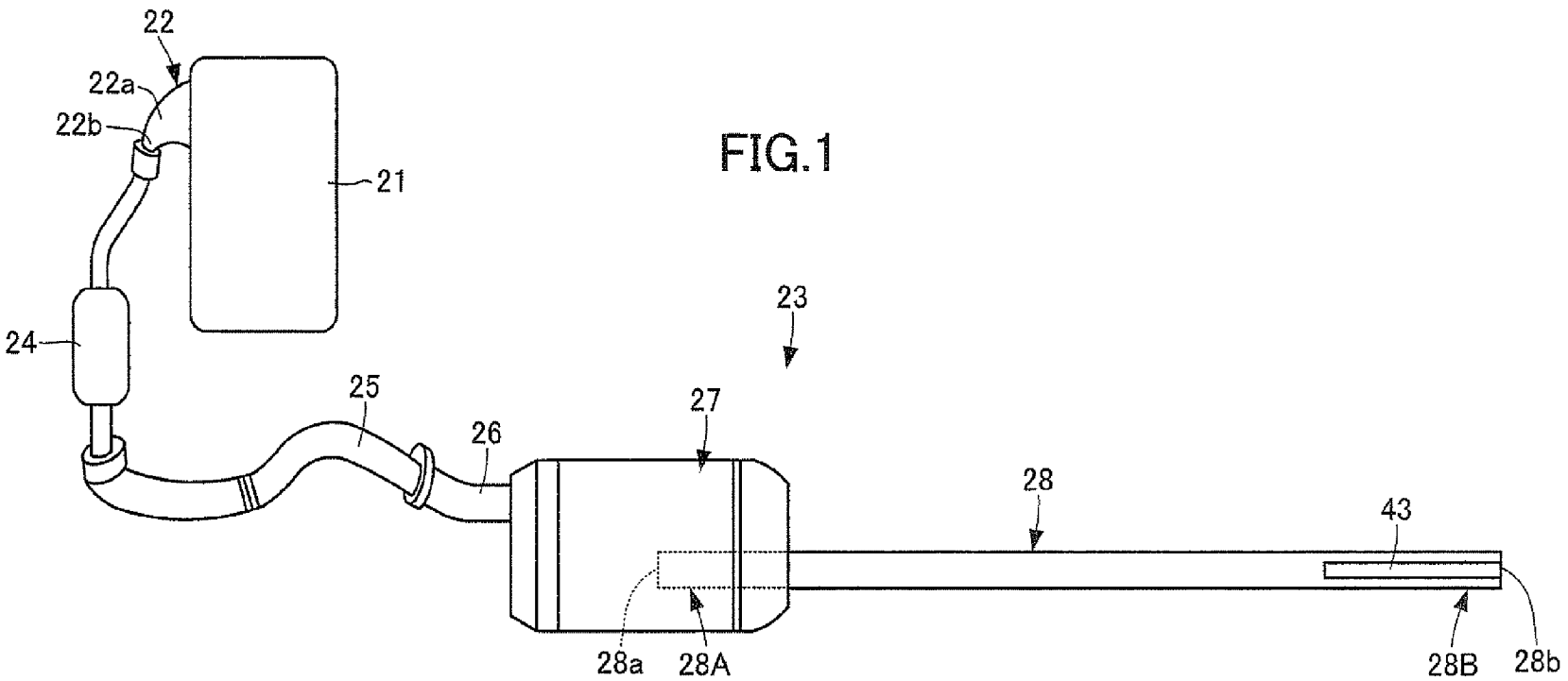
FIG. 1 is a view showing a first embodiment of the exhaust pipe part and the exhaust apparatus for the internal combustion engine according to the present invention, and a constitution view of the exhaust apparatus for the internal combustion engine.

The embodiment of the exhaust pipe part and the exhaust apparatus for the internal combustion engine according to the present invention will be described hereinafter with referenced to the accompanying drawings.

(First Embodiment)

FIGS. 1 to 17 are views respectively showing first embodiment of the exhaust pipe part and the exhaust apparatus for the internal combustion engine according to the present invention.

The construction of the first embodiment will firstly be explained hereinafter.

The engine 21 is not limited to the straight 4-cylinder internal combustion engine, but may be constituted by a straight 3-cylinder internal combustion engine or a straight no less than 5-cylinder internal combustion engine. The engine 21 may be a V-type engine having no less than three cylinders respectively mounted on the banks divided right and left.

The exhaust manifold 22 is constituted by four exhaust gas branch pipes 22*a* (only one shown) respectively connected to exhaust ports formed to be held in communication with the first to fourth cylinders of the engine 21, and an exhaust gas collecting pipe 22*b* constructed to collect the downstream sides of the exhaust gas branch pipes 22*a*, so that the exhaust gas discharged from the cylinders of the engine 21 can be introduced into the exhaust gas collecting pipe 22*b* through the exhaust gas branch pipes 22*a*.

The exhaust apparatus 23 is provided with a catalytic converter 24, a cylindrical front pipe 25, a cylindrical center pipe 26, a muffler 27 serving as a sound deadening device, and a cylindrical tail pipe 28. The exhaust apparatus 23 is installed at the downstream side of the exhaust gas discharging direction of the engine 21 in such a manner that the exhaust apparatus 23 is resiliently hanging from the floor of the vehicle. The term "upstream side" indicates an upstream side in the discharging direction of the exhaust gas, while the term "downstream side" indicates a downstream side in the discharging direction of the exhaust gas.

The upstream end of the catalytic converter 24 is connected to the downstream end of the exhaust gas collecting pipe 22*b*, while the downstream end of the catalytic converter 24 is connected to the front pipe 25. The catalytic converter 24 is constructed by a case housing therein a honeycomb substrate or a granular activated alumina-made carrier deposited with catalysts such as platinum and palladium to perform reduction of Nox, and oxidization of CO, HC.

The downstream end of the front pipe 25 is connected with the upstream end of the center pipe 26, while the downstream end of the center pipe 26 is connected with the muffler 27 which is adapted to mute the exhaust gas sound.

Figure 2:
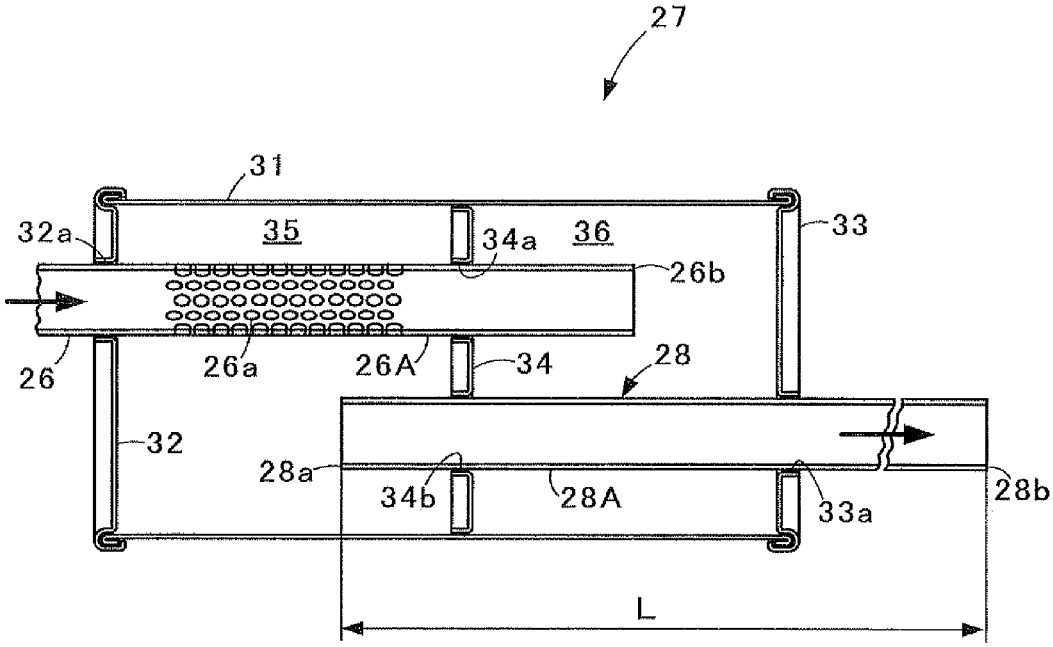
FIG. 2 is a view showing the first embodiment of the exhaust pipe part and the exhaust apparatus for the internal combustion engine according to the present invention, and a cross-sectional view of a muffler to which is connected a tail pipe.

As shown in FIG. 2, the muffler 27 is provided with an outer shell 31 formed in a cylindrical shape, and end plates 32, 33 for closing the both ends of the outer shell 31. The outer shell 31 is provided therein with a partition plate 34 which is adapted to divide the outer shell 31 into an expansion chamber 35 for expanding the exhaust gas to deaden the exhaust gas sound, and a resonance chamber 36 for muting the exhaust gas sound with a specified frequency by the Helmholtz resonance effect.

The end plate 32 and the partition plate 34 are formed with through bores 32*a*, 34*a*, respectively. The through bores 32*a*, 34*a* allow the downstream portion of the center pipe 26 (hereinafter referred to as an inlet pipe portion 26A forming part of the center pipe 26) to pass therethrough.

The inlet pipe portion 26A is supported on the end plate 32 and the partition plate 34 to be accommodated in the expansion chamber 35 and the resonance chamber 36 with the downstream opening end 26*b* being open to the resonance chamber 36.

The inlet pipe portion 26A is formed with a plurality of small through bores 26*a* formed to be arranged in the axial direction, i.e., the gas discharging direction of the exhaust gas, of the inlet pipe portion 26A and in the circumferential direction of the inlet pipe 26A, so that the inner chamber of the inlet pipe portion 26A is held in communication with the expansion chamber 35 through the small through bores 26*a*.

Therefore, the exhaust gas introduced into the muffler 27 through the inlet pipe portion 26A of the center pipe 26 is introduced into the expansion chamber 35 through the small through bores 26*a* and then introduced into the resonance chamber 36 through the downstream open end 26*b* of the inlet pipe portion 26A.

The exhaust gas sound of the exhaust gas with a specified frequency (Hz) can be muted by the Helmholtz resonance effect when the exhaust gas is introduced into the resonance chamber 36. More specifically, the resonance chamber 36 can tune the resonance frequency toward the low frequency by increasing the volume of the resonance chamber 36 or by lengthening the length of the projection portion of the center pipe 26 projecting into the resonance chamber 36. On the other hand, the resonance chamber 36 can tune the resonance frequency toward the high frequency by decreasing the volume of the resonance chamber 36 or by shortening the length of the projection portion of the center pipe 26 projecting into the resonance chamber 36.

The partition plate 34 and the end plate 33 are formed with through bores 34*b*, 32*a*, respectively. The through bores 34*a*, 33*a* allow the upstream portion 28A (one end portion) of the tail pipe 28 to extend therethrough.

The upstream portion 28A of the tail pipe 28 is provided at its upstream end with an upstream open end 28*a*. The upstream portion 28A of the tail pipe 28 passes through the through bores 34*b*, 33*a* to be connected with the muffler 27 with the upstream open end 28*a* being open to the expansion chamber 35.

The downstream portion (the other end portion) 28B of the tail pipe 28 is provided at its downstream end with a downstream open end 28*b* held in communication with the atmosphere. This means that the exhaust gas introduced into the upstream open end 28*a* of the tail pipe 28 from the expansion chamber 35 of the muffler 27 is discharged through the tail pipe 28 from the downstream open end 28*b* to the atmosphere.

More specifically, the tail pipe 28 according to the present embodiment has an upstream open end 28*a* at the upstream portion 28A, and a downstream open end 28*b* at the downstream portion 28B, the upstream open end 28*a* being connected with the muffler 27 at the upstream side in the exhaust gas direction of the exhaust gas discharged from the engine 21, while the downstream open end 28*b* allowing the exhaust gas to be discharged to the atmosphere.

Therefore, the upstream portion 28A and the downstream portion 28B of the tail pipe 28 are respectively indicative of portions upstream and downstream of the tail pipe 28 having the upstream open end 28*a* and the downstream open end 28*b*, respectively. Each of the upstream portion 28A and the downstream portion 28B of the tail pipe 28 has a predetermined length.

Figure 3:
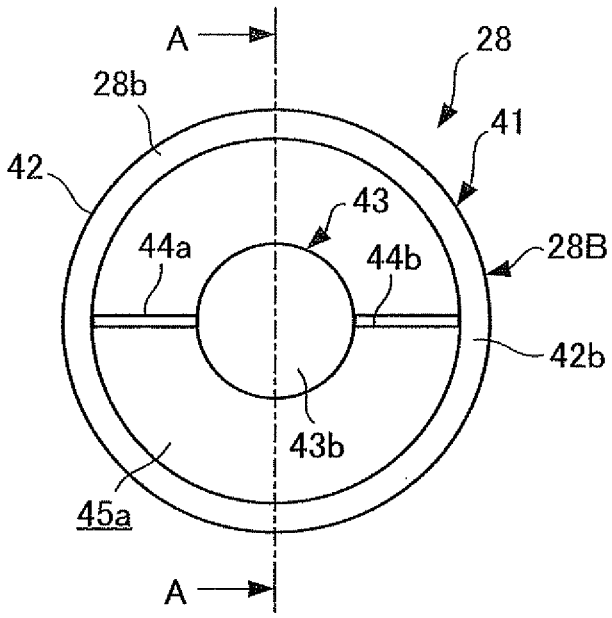
FIG. 3 is a view showing the first embodiment of the exhaust pipe part and the exhaust apparatus for the internal combustion engine according to the present invention, and a front view of the tail pipe seen from the axial direction thereof.
Figure 4:
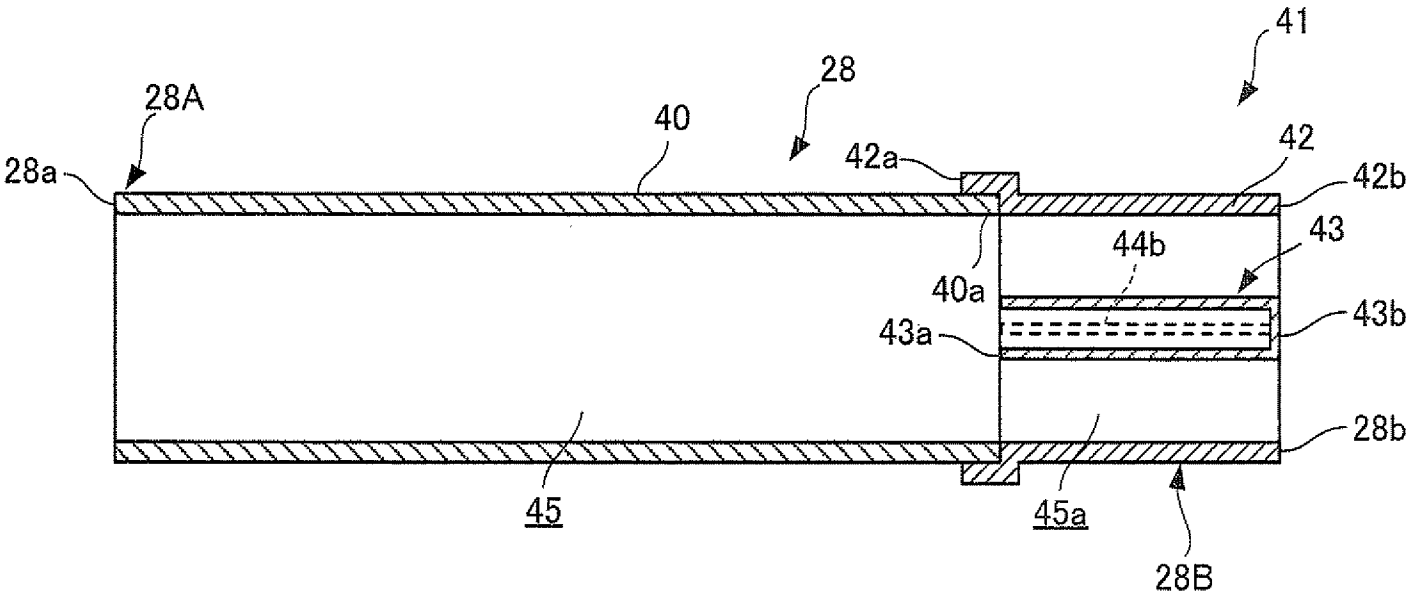
FIG. 4 is a cross-sectional view of the tail pipe taken along and seen from the line A-A of FIG. 3.
Figure 5:
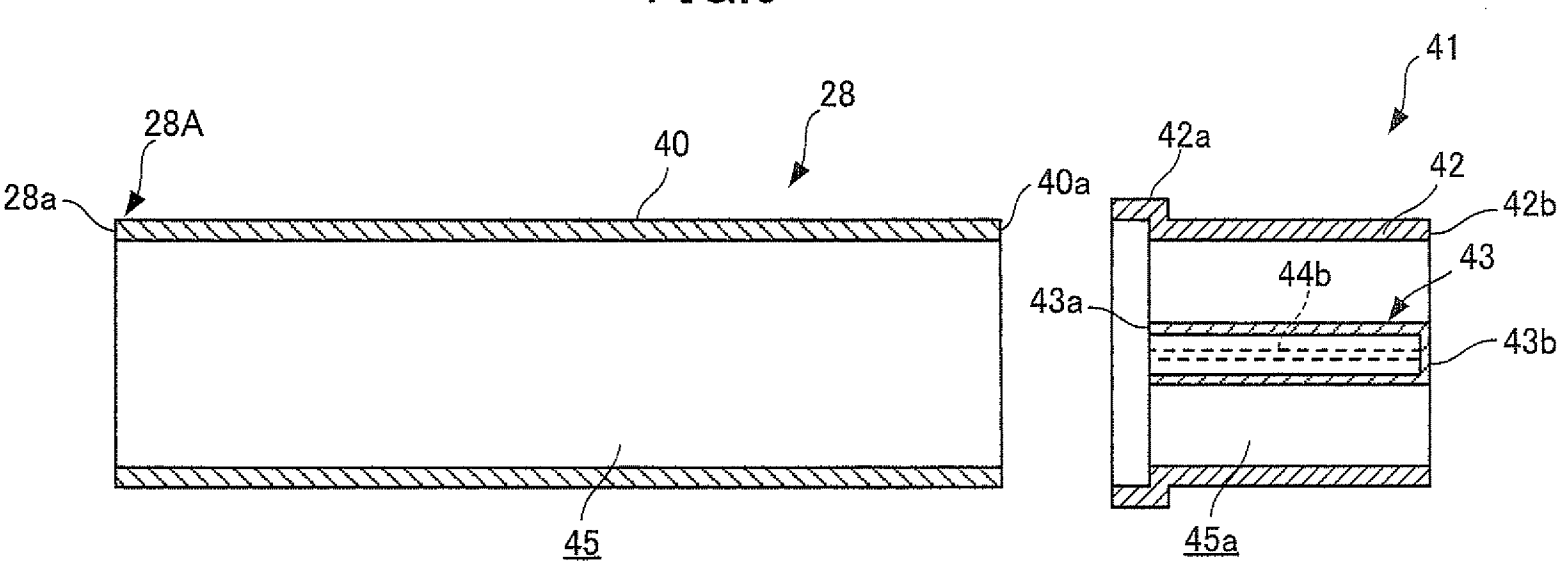
FIG. 5 is a view showing the first embodiment of the exhaust pipe part and the exhaust apparatus for the internal combustion engine according to the present invention, and an exploded view of a pipe body forming part of the tail pipe and the exhaust pipe part axially separated from each other.

As shown in FIGS. 3 to 5, the tail pipe 28 is provided with a pipe body 40 and an exhaust pipe part 41 both of which are integrally formed. In other words, the exhaust pipe part 41 constitutes the downstream portion 28B of the tail pipe 28 which is part of the tail pipe 28. The exhaust pipe part 41 is constituted by a hollow member 42, a short pipe 43, and brackets 44*a*, 44*b* intervening between the hollow member 42 and the short pipe 43.

The upstream open end portion (axially other end portion of the hollow member) 42*a* of the hollow member 42 has a diameter expansion portion formed to have an inner diameter larger than the outer diameter of the pipe body 40. The hollow member 42 is securely connected to the pipe body 40 in such a manner that the upstream open end portion 42*a* is fastened by a welding method and the like to the outer peripheral portion of the downstream end portion 40*a* of the pipe body 40.

More specifically, the hollow member 42 according to the present embodiment is connected with the pipe body 40 in axial alignment with the pipe body 40. For fastening the hollow member 42 to the pipe body 40, the above welding method may be replaced by bolts and other fastening members. The hollow member 42 has an inner diameter equal to that of the pipe body 40, so that the tail pipe 28 has the same inner diameter in the whole axial length thereof.

The short pipe 43 has an outer peripheral portion fastened by a welding method and other fastening methods to the inner peripheral portions of the brackets 44*a*, 44*b* in a plate-like form. The outer peripheral portions of the brackets 44*a*, 44*b* are also fastened by the welding and other fastening methods to the inner peripheral portion of the hollow member 42. This means that the short pipe 43 is fastened to the hollow member 42 through the brackets 44*a*, 44*b*.

The short pipe 43 has an open end 43*a* at the upstream end constituting an axial other end thereof, and a bottom plate 43*b* forming a closed end at the downstream end constituting an axial one end thereof. This means that the short pipe 43 is formed in a bottomed cylindrical shape.

The short pipe 43 has a cross-section area uniformed in the axial direction thereof, and is arranged in the tail pipe 28 to have a center axis extending on the center axis of the tail pipe 28.

The exhaust pipe part 41 according to the present embodiment is fastened to the pipe body 40 and forms a tail pipe 28 together with the pipe body 40, so that the downstream open end (axial other end) 42*b* of the hollow member 42 constitutes the downstream open end 28*b* of the tail pipe 28.

The bottom plate 43*b* of the short pipe 43 is positioned in coplanar relationship with the downstream end 28*b* of the tail pipe 28, viz., the downstream open end (axial one end of the hollow member 42) of the hollow member 42. The short pipe 43 has a predetermined length, and extends toward the pipe body 40 from the bottom plate 43*b* to be open at the open end 43*a*.

The present embodiment is constructed to have the bottom plate 43*b* of the short pipe 43 positioned in coplanar relationship with the downstream open end 28*b* of the tail pipe 28, so that the bottom plate 43*b* of the short pipe 43 is positioned at a node portion of a standing wave in a sound pressure distribution of an air column resonance generated in the tail pipe 28. The bottom plate 43*b* of the short pipe 43 may be somewhat displaced to the upstream side or the downstream side from the position of the node portion of the standing wave in the sound pressure distribution of the air column resonance generated in the tail pipe 28.

Here, the standing wave of the air column resonance generated in the tail pipe 28 is remarkably increased in amplitude to cause the air column resonance under the condition that the length L of the tail pipe 28 and the wave length $\lambda$ of the standing wave come to be a special relationship with each other. The air column resonance has a basic frequency with a half wavelength equal to the pipe length L of the tail pipe 8, and has a wavelength natural number times the half wavelength when the air column resonance is generated to increase the sound pressure.

Figure 6:
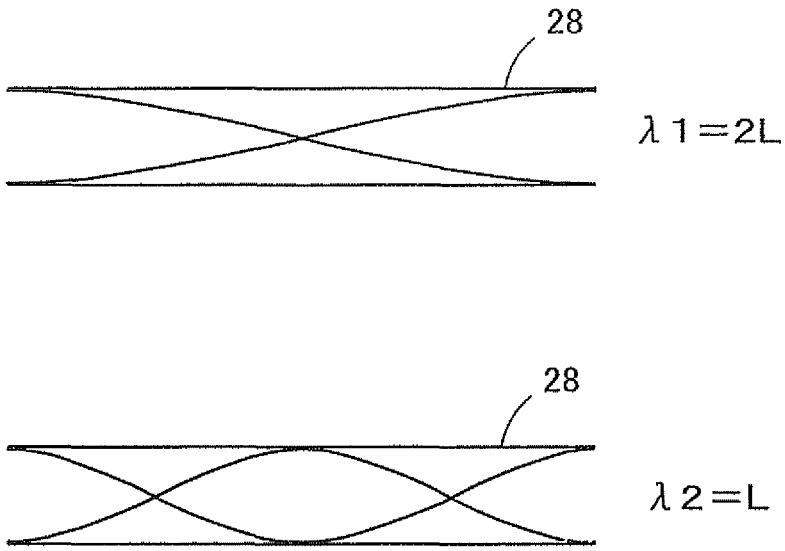
FIG. 6 is a view showing the first embodiment of the exhaust pipe part and the exhaust apparatus for the internal combustion engine according to the present invention, and a view for explaining standing waves of particle speed distribution of air column resonance generated by an open end reflection in the tail pipe.

As more particularly shown in FIG. 6, the standing waves of the air column resonance generated in the tail pipe 28 respectively have particle speed distributions in which the wave length $\lambda 1$ of the air column resonance having a fundamental vibration (primary component) is roughly double the length L of the tail pipe 28, while the wave length $\lambda 2$ of the air column resonance having a secondary component is roughly one time, viz., equal to the length L of the tail pipe 28.

As will be seen clearly from FIG. 6, the standing waves respectively have abdominal portions in the particle speed at the upstream open end 28*a* and the downstream open end 28*b* of the tail pipe 28, and the particle speeds become highest at the upstream open end 28*a* and the downstream open end 28*b* of the tail pipe 28.

Figure 7:
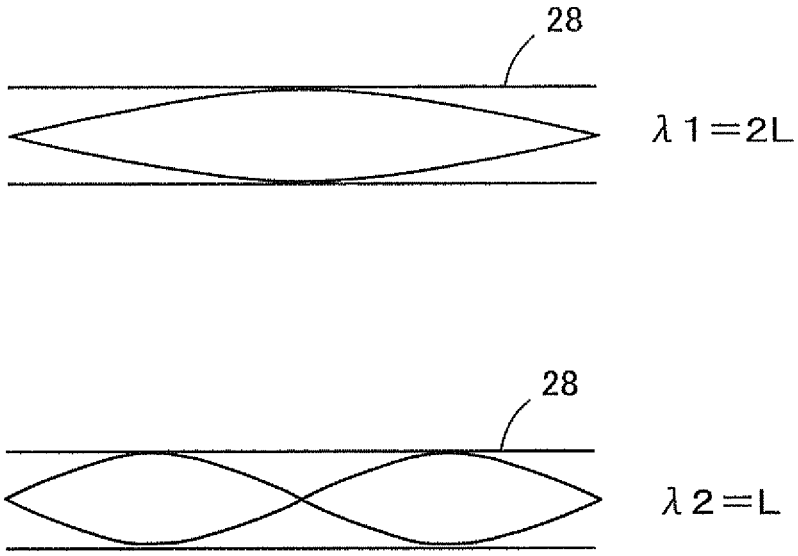
FIG. 7 is a view showing the first embodiment of the exhaust pipe part and the exhaust apparatus for the internal combustion engine according to the present invention, and a view for explaining standing waves of sound pressure distribution of the air column resonance generated by the open end reflection in the tail pipe.

The sound pressure distributions of the standing waves of the air column resonances having the primary and secondary components are shown in FIG. 7 in which the standing waves in the sound pressure distribution have respective abdominal portions and node portions completely opposite to the abdominal portions and node portions of the sanding waves in the particle speed distribution. This means that the upstream open end 28*a* and the downstream open end 28*b* of the tail pipe 28 respectively form the node portions of the sound pressure distribution, and thus the sound pressures become lowest at the upstream open end 28*a* and the downstream open end 28*b* of the tail pipe 28.

The short pipe 43 is set to have a length less than or equal to $\frac{1}{8}\times\lambda$ with respect to the wave length $\lambda$ of the standing wave of the air column resonance generated in the tail pipe 28. In the present embodiment, the short pipe 43 is provided at the downstream portion 28B of the tail pipe 28, and $\lambda 1=2L$ as shown in FIG. 6, so that the length of the short pipe 43 is set to have a length ¼ the pipe length of the tail pipe 28.

Further, the short pipe 43 may be set to have a length less than or equal to ⅛×λ with respect to the wave length λ of the standing wave of the air column resonance, viz., less than ¼ the pipe length of the tail pipe 28.

The present embodiment is constructed to have the short pipe 43 extend along the center axis of the downstream portion 28B of the tail pipe 28 in the form of a straight pipe having the same inner diameter, the short pipe 43 having a length ¼ the pipe length of the tail pipe 28 as previously mentioned. Therefore, as the volume per unit length of the exhaust passage 45*a* of the downstream portion 28B is smaller than the volume per unit length of the exhaust passage 45 of the tail pipe 28, the volume of the exhaust passage 45*a* between the short pipe 43 and the downstream portion 28B is reduced, viz., becomes small.

For this reason, the reduced volume per unit length of the downstream portion 28B of the tail pipe 28 makes it possible to raise the particle speed of the standing wave of the air resonance at the downstream portion 28B of the tail pipe 28, by taking advantage of the fact that the particle speed of the air column resonance in the node portion of the sound pressure of the standing wave of the air column resonance becomes maximum as shown in FIGS. 6 and 7.

The short pipe 43 has a size set in such a manner that the volume of the exhaust passage 45 of the tail pipe 28 having the short pipe 43 is reduced by a volume reduction amount from the whole volume of the exhaust passage 45 of the tail pipe 28 having no short pipe 43, the volume reduction amount being no less than 2.5%

In the present embodiment, the brackets 44*a*, 44*b* provided on the downstream portion 28B of the tail pipe 28 are each in a plate-like shape, so that the cross-sectional areas of the brackets 44*a*, 44*b* are smaller than the cross-sectional area of the short pipe 43. For this reason, the reduction amount of the volume of the exhaust passage 45 is dependent largely on the cross-sectional area of the short pipe 43.

Further, the size of the short pipe 43 indicates the volume of the short pipe 43 which is assumed to be in a solid shaft shape. In this case, the volume of the short pipe 43 is more than or equal to 2.5% of the volume of the exhaust passage 45 of the tail pipe 28 when the short pipe 43 is not provided in the tail pipe 28.

Here, the exhaust passage 45 is a whole space surrounded by the tail pipe 28, viz., the pipe body 40 and the hollow member 42. The exhaust passage 45*a* is constituted by the space surrounded by the outer peripheral portion of the short pipe 43 and the inner peripheral portion of the hollow member 42.

Next, the operation will be explained hereinafter.

The exhaust gas discharged from each of the cylinders of the engine 21 at the operation time of the engine 21 is introduced from the exhaust manifold 22 into the catalytic converter 24 by which the reduction action of Nox, and the oxidization action of CO, HC are performed.

The exhaust gas discharged from the catalytic converter 24 is introduced into the muffler 27 through the front pipe 25 and the center pipe 26. The exhaust gas introduced into the muffler 27 through the inlet pipe portion 26A of the center pipe 26 is introduced into the expansion chamber 35 through the small through bores 26*a* and into the resonance chamber 36 through the downstream opened end 26*b* of the inlet pipe portion 26A. The exhaust gas sound of the exhaust gas with a specified frequency (Hz) can be muted by the Helmholtz resonance effect when the exhaust gas is introduced into the resonance chamber 36.

The exhaust gas introduced into the expansion chamber 35 is introduced into the tail pipe 28 through the upstream open end 28*a* of the tail pipe 28, and then is discharged to the atmosphere through the downstream open end 28*b* of the tail pipe 28.

The exhaust gas sound of the exhaust gas introduced into the tail pipe 28 at the operation time of the engine 21 is a pulsated incident wave which is varied in response to the rotation number of the engine 21. The incident wave has a frequency increased as the rotation number of the engine 21 is increased.

When the incident wave pulsated at the operation time of the engine 21 is introduced into the tail pipe 28, the incident wave is reflected at the downstream open end 28*b* of the tail pipe 28 to cause what is called an open end reflection. The reflection wave thus caused is the same in phase as the incident wave but opposite in direction to the incident wave. The reflection wave is reflected again at the upstream open end 28*a* of the tail pipe 28 to cause what is called the open end reflection. The reflection wave thus caused is the same in phase as the incident wave but opposite in direction to the incident wave similarly to the reflection wave previously mentioned. The reflection wave in turn becomes an incident wave and then another reflection wave at the upstream open end 28*a*.

The reason why the open end reflection is caused at the downstream open end 28*b* will be able to be explained with the following description. The pressure of the exhaust gas flowing in the tail pipe 28 is high, while the atmospheric pressure outside the downstream open end 28*b* of the tail pipe 28 is lower than the pressure of the exhaust gas flowing in the tail pipe 28. The incident wave is violently discharged out into the atmosphere through the downstream open end 28*b*, thereby causing a low-pressure portion where the pressure of the exhaust gas inside of the downstream open end 28*b* become low. This is because the low pressure-portion starts moving toward the upstream open end 28*a* in the tail pipe 28.

This means that the reflection wave is the same in phase as the incident wave but opposite in direction to the incident wave. The reason why the reflection wave is generated at the upstream open end 28*a* is the same as that of the reflection wave generated at the downstream open end 28*h* as previously mentioned.

The incident wave moving toward the downstream open end 28*b* interferes with the reflection wave moving in the direction away from the downstream open end 28*b*. As shown in FIG. 6, the reflection wave and the incident wave thus generated to interfere with each other lead to causing a standing wave having the maximum particle speed at each of the upstream open end 28*a* and the downstream open end 28*b*.

When the standing wave is caused under the special relationship between the pipe length L of the tail pipe 28 and the wavelength λ of the standing wave, the standing wave comes to have remarkably large amplitude, thereby causing an air column resonance. The air column resonance has a fundamental frequency with a half wavelength formed by the pipe length L of the tail pipe 28. The air column resonance is generated with the frequency having several natural number times the half wavelength, thereby increasing the sound pressure.

Here, if the sound speed is represented by "c", the length of the tail pipe 28 is represented by "L", and the degree is represented by "m", the air column resonance frequency "fm" of the tail pipe 8 can be given by the following equation (2).

$$fm=(c/2L)\cdot m \quad (2)$$

Figure 8:
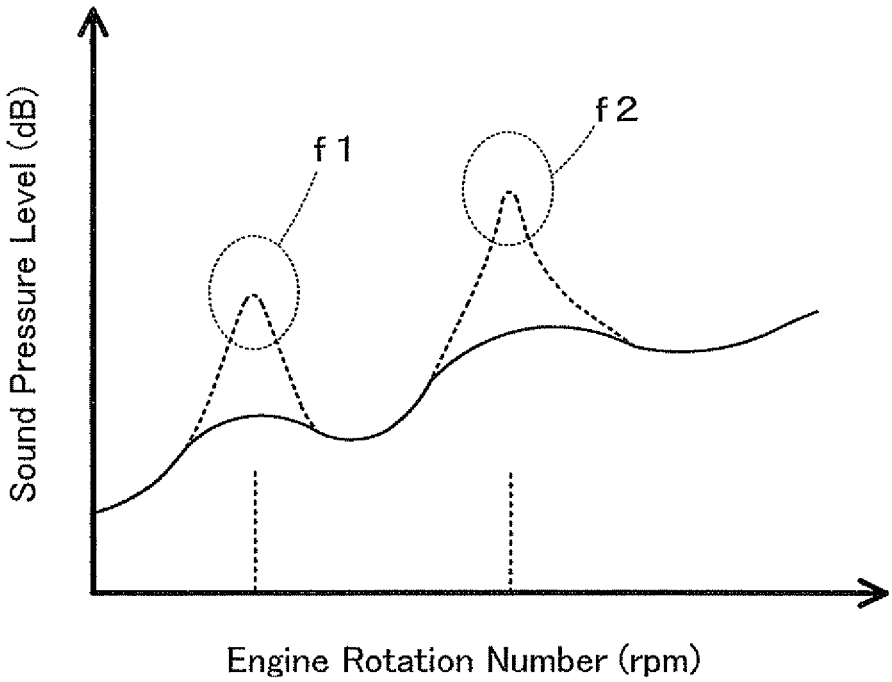
FIG. 8 is a view showing the first embodiment of the exhaust pipe part and the exhaust apparatus for the internal combustion engine according to the present invention, and a view showing the relationship between the sound pressure level generated in the tail pipe and the engine rotation number.

As shown in FIG. 8, the pulsated frequency of the engine 21 is increased in response to the increased rotation number of the engine 21. The sound pressure levels (dB) are heightened at the primary component f1 and the secondary component f2 of the exhaust gas sound in the air column resonances caused in response to the rotation numbers of the engine 21, respectively.

Therefore, in the case of employing the tail pipe 8 relatively long in length (for example, the length of the tail pipe 8 is larger than 1.5 m), there is sometimes generated an air column in the normal rotation number area (2000 rpm~5000 rpm) which is low in the rotation number of the engine.

In particular, the peak value (the width of the abdominal portion in the sound pressure distribution) of the primary component f1 of the air column resonance is larger than the peak value of the secondary component 12 of the air column resonance, and thus generates unpleasant noises called muffled sounds in the normal rotation number area. The air column resonance with such a peak value leads to becoming a cause of deteriorating the noises of the exhaust gas and thus giving the unpleasant feelings to the driver.

In view of this problem, the present embodiment is aimed to reduce the sound pressure levels of the primary component f1 and the secondary component f2 of the air column resonance frequencies at the time of the air column resonances caused in the normal rotation number area of the engine 21, thereby reducing the noises of the exhaust gas and preventing the unpleasant feelings from being given to the driver.

Firstly, the reason why the sound pressure level caused by the air column resonance can be suppressed will be explained hereinafter.

Figure 9:
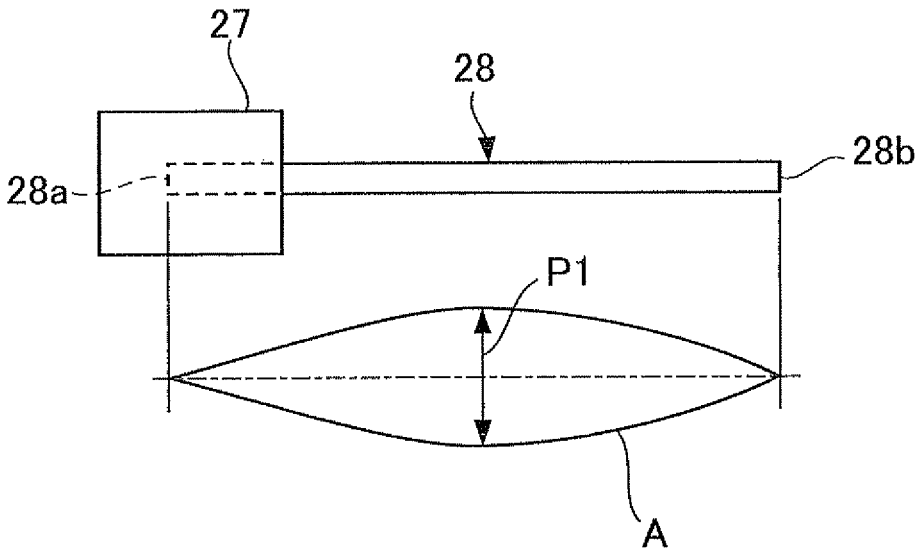
FIG. 9 is a view showing the first embodiment of the exhaust pipe part and the exhaust apparatus for the internal combustion engine according to the present invention, and a view showing the potential energy of the air column resonance generated in the tail pipe.

FIG. 9 shows a sound pressure distribution of the primary component f1 of the standing wave of the air column resonance when the air column is generated in the tail pipe 28 with no short pipe 43. Each of the upstream open end 28*a* and the downstream open end 28*b* of the tail pipe 28 is shown in FIG. 9 to form a node portion of the sound pressure distribution of the standing wave of the air column resonance, thereby leading to having the sound pressure of the standing wave of the air column resonance come to be at a minimum level at each of the upstream open end 28*a* and the downstream open end 28*b* of the tail pipe 28. On the other hand, the central portion of the tail pipe 28 forms an abdominal portion of the sound pressure distribution of the standing wave of the air column resonance, thereby leading to having the sound pressure of the standing wave of the air column resonance come to be at a maximum level or at a peak P1 at the central portion of the tail pipe 28.

Figure 10:
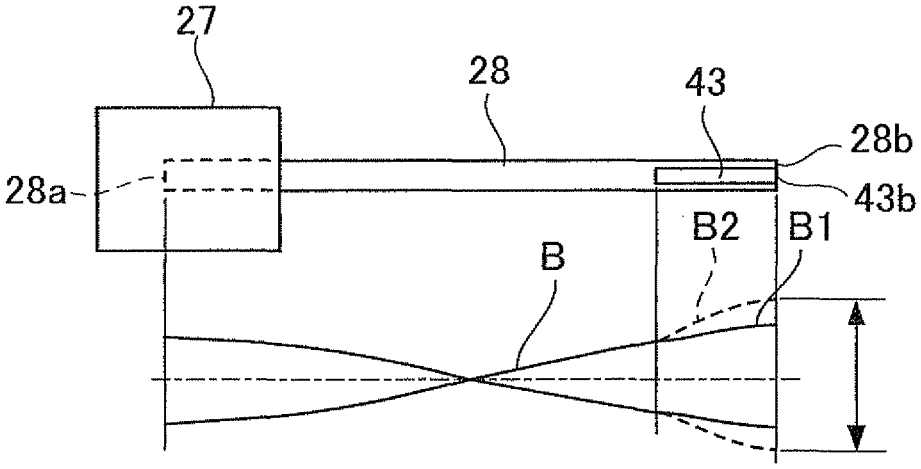
FIG. 10 is a view showing the first embodiment of the exhaust pipe part and the exhaust apparatus for the internal combustion engine according to the present invention, and a view showing the fluctuation of the particle speed of the air column resonance generated in the downstream portion of the tail pipe.

FIG. 10 shows a sound pressure distribution of the primary component f1 of the standing wave of the air column resonance when the air column resonance is generated in the tail pipe 28. Each of the upstream open end 28*a* and the downstream open end 28*b* of the tail pipe 28 is shown in FIG. 10 to form an abdominal portion of the sound pressure distribution of the standing wave of the air column resonance, thereby leading to having the particle speed of the standing wave of the air column resonance come to be at a maximum level at each of the upstream open end 28*a* and the downstream open end 28*b* of the tail pipe 28. On the other hand, the central portion of the tail pipe 28 forms a node portion of the sound pressure distribution of the standing wave of the air column resonance, thereby leading to causing no movement of the particle at the central portion of the tail pipe 28.

In the present embodiment, there is provided in the downstream portion 28B of the tail pipe 28 a short pipe 43 in the form of a bottomed cylindrical shape and having an open end 43*a*, and a closed end 43*b* formed by a bottom plate which is positioned at the node portion of the sound pressure distribution of the standing wave of the air column resonance caused in the tail pipe 28. This means that at the position of the node portion of the sound pressure distribution having a maximum value in the particle speed of the standing wave when the air column resonance is caused in the tail pipe 28, the short pipe 43 can accumulate therein the potential energy of the air column resonance in the tail pipe 28.

It is generally known that the system of the air column resonance generated in the tail pipe 28 has dynamic energy which is represented by the addition of kinetic energy and potential energy (mass of exhaust gas), and which is preserved.

The following description will be directed to the potential energy to be examined.

Figure 11:
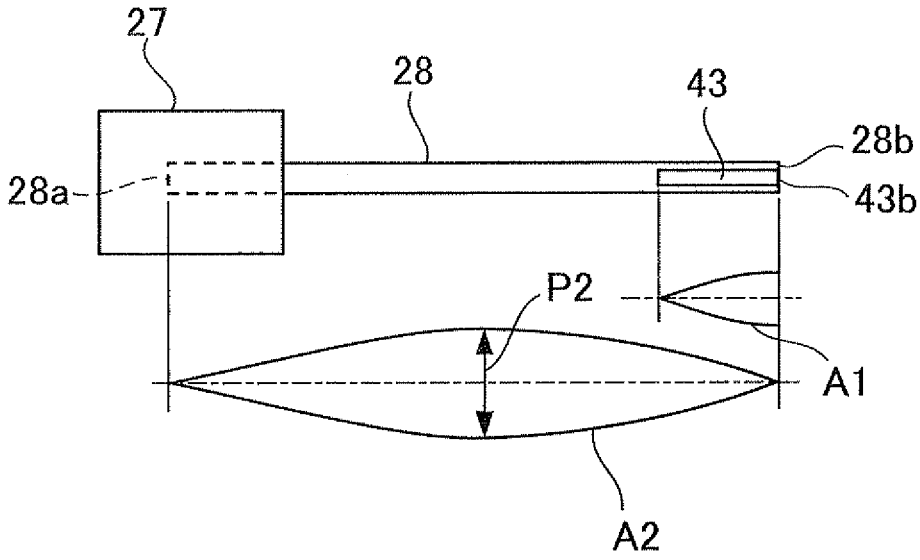
FIG. 11 is a view showing the first embodiment of the exhaust pipe part and the exhaust apparatus for the internal combustion engine according to the present invention, and a view showing the distributed state of the potential energy of the air column resonance generated in the tail pipe.

The position of the node portion of the sound pressure distribution allows the sound pressure to be at a minimum level, however, allows the particle speed to be at a maximum level, so that the potential energy of the air column resonance in the tail pipe 28 is, as shown in FIG. 11, accumulated in the short pipe 43 provided at the position where the sound pressure is low, and thus becomes potential energy A1 in a mode in which the sound pressure near the bottom plate 43*b* is high as compared with the sound pressure near the open end 43*a*. The potential energy A1 is by no means discharged to the outside.

The potential energy A1 accumulated in the short pipe 43 is produced by the potential energy of the exhaust gas in the tail pipe, so that there is generated no change in the potential energy in the system. However, the preservation principle of the dynamic energy allows the potential energy A in the tail pipe 28 shown in FIG. 9 to be distributed into potential energy A1 in the short pipe 43 and potential energy A2 in the tail pipe 28 with the short pipe 43 removed therefrom. Only the potential energy A2 in the tail pipe 28 with the short pipe 43 removed therefrom is discharged to the outside.

Figure 12:
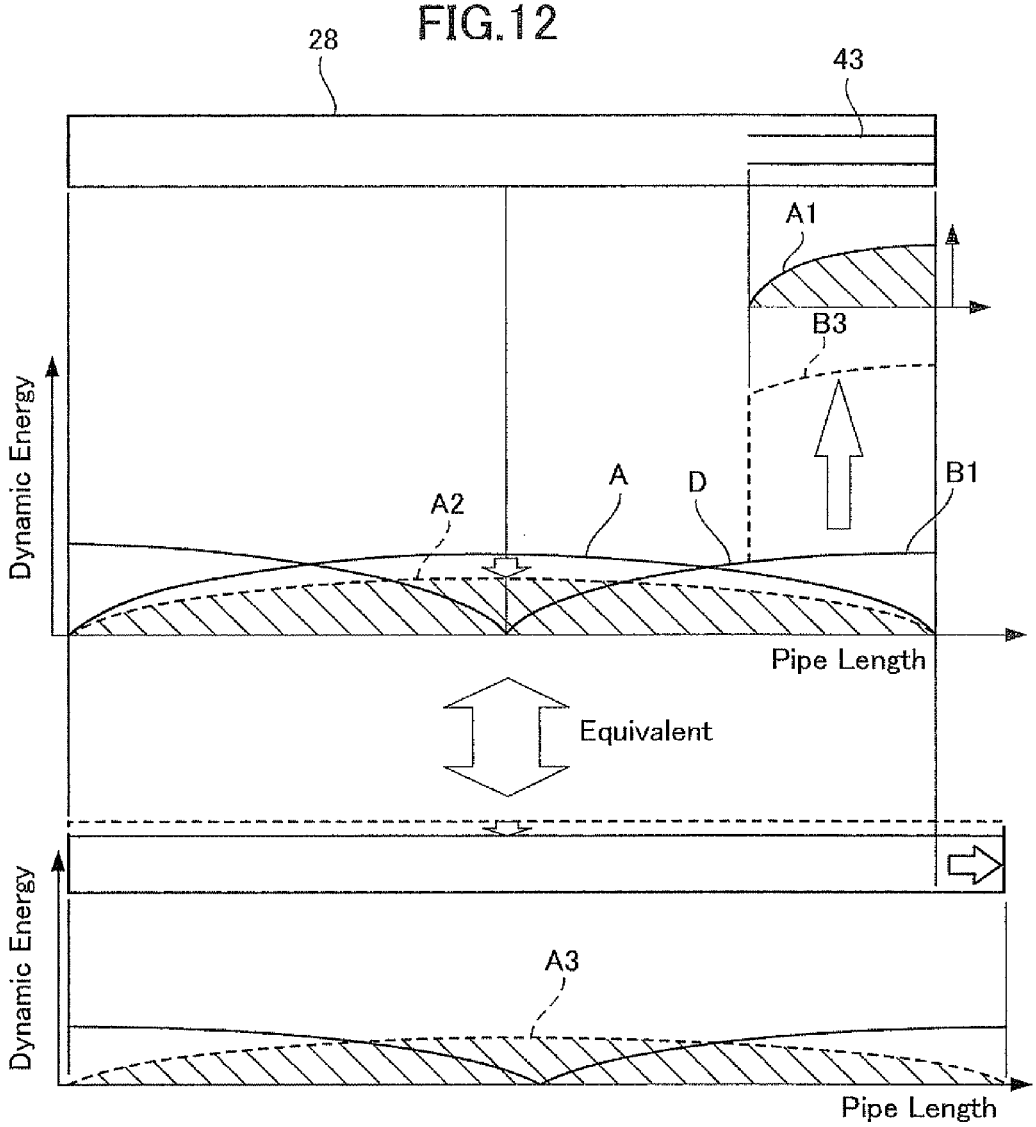
FIG. 12 is a view showing the first embodiment of the exhaust pipe part and the exhaust apparatus for the internal combustion engine according to the present invention, and a view showing a situation of dynamic energy in the tail pipe for explaining a principle about the reduction of the potential energy in the exhaust pipe and the pseudo length of the tail pipe lengthened.

In other words, the remaining potential energy A2 (shown by hatching) obtained by subtracting the energy A1 (also shown by hatching) in the short pipe 43 from the potential energy A of the tail pipe 28 as shown in FIG. 12 is discharged to the outside.

The sound pressure level caused by the air column resonance depends on the potential energy. This means that the decreased potential energy, viz., only the potential energy A2 among the potential energies in the tail pipe 28 makes it possible to lower the peak of the sound pressure from the peak P1 to the peak P2 (see FIG. 11) and thus to reduce the pressure level. As a result, it is possible to reduce the exhaust noises by the reduction amount of the potential energy.

Next, considering the kinetic energy of the exhaust gas, the present embodiment is constructed with the short pipe 43 provided on the downstream portion 28B to extend in the axial direction of the tail pipe 28, and the volume per unit length of the exhaust passage 45*a* of the downstream portion 28B of the tail pipe 28 is smaller than the volume per unit length of the exhaust passage 45 of the tail pipe 28, so that the particle speed B in the tail pipe 28 is raised from the particle speed B1 shown in solid lines to the particle speed B2 shown in broken lines in the downstream portion 28B as shown in FIG. 10.

The following description will then be directed to the particle speed which is considered with the kinetic energy. The kinetic energy is in proportion to square speed, and thus the kinetic energy in the exhaust passage 45 in the tail pipe 28 is increased by the square particle speed increased. The increased level of the kinetic energy is shown in FIG. 12, showing that the kinetic energy is drastically increased from the position shown by B1 to the position shown by B3.

As explained in the above, the potential energy A of the air column resonance in the tail pipe 28 is distributed into the potential energy A2 in the tail pipe 28 and the potential energy A1 in the short pipe 43. The potential energy A is as a whole not varied while the kinetic energy is drastically increased, thereby making it possible to increase the dynamic energy, viz., the addition of the potential energy and the kinetic energy.

Therefore, the dynamic energy of the air column resonance in the tail pipe 28 is preserved to lengthen the tail pipe 28 in a pseudo form, so that the frequency of the air column resonance can be decreased to the frequency of the air column resonance equal to that of the tail pipe having a long length.

The reason why the tail pipe 28 is lengthened in the pseudo form will more specifically be explained hereinafter.

Figure 13:
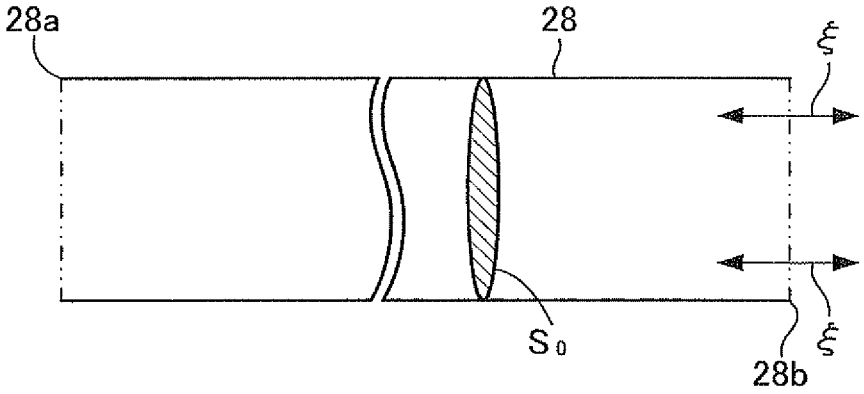
FIG. 13 is a view showing the first embodiment of the exhaust pipe part and the exhaust apparatus for the internal combustion engine according to the present invention, and a rough view of the tail pipe provided with no short pipe for explaining a principle about the pseudo length of the tail pipe lengthened.

When there is caused an air column resonance in the tail pipe 28 with no short pipe 43 provided on the downstream portion 28B of the tail pipe 28 having a cross-sectional area $S_0$, and a length L, the particle speed of the standing wave in the downstream portion 28B of the tail pipe 28 is represented by ξ as shown in FIG. 13.

Figure 14:
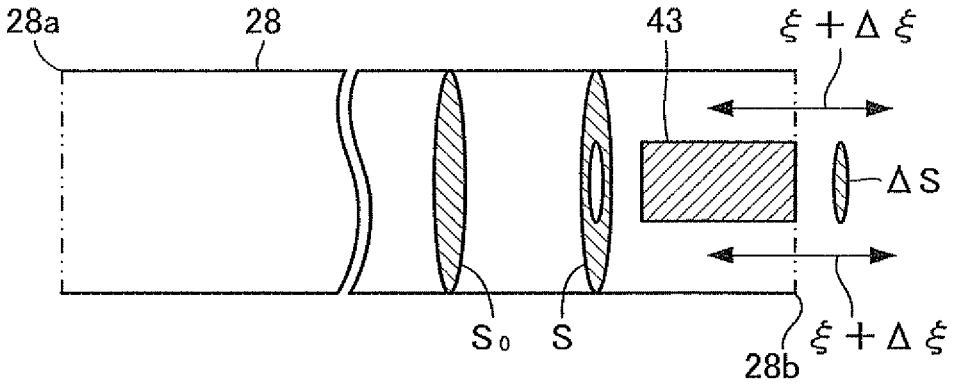
FIG. 14 is a view showing the first embodiment of the exhaust pipe part and the exhaust apparatus for the internal combustion engine according to the present invention, and a rough view of the tail pipe provided with a short pipe for explaining a principle about the pseudo length of the tail pipe lengthened.

Next, as shown in FIG. 14, consideration is paid for the case that the upstream open end 28*a* of the tail pipe 28 having a cross-sectional area $S_0$ and a length L is assumed to be an origin, taking an X axis in the axial direction of the tail pipe 28. The cross-sectional area of the downstream portion 28B is decreased with the short pipe 43 having a cross-sectional area ΔS attached to the downstream portion 28B of the tail pipe 28. The cross-sectional area of the downstream portion 28B can thus be represented with the formula $S=S_0-\Delta S$. Here, the variation of the cross-sectional area ΔS is assumed to take an extremely small value. At this time, the particle speed of the standing wave in the downstream portion 28B of the tail pipe 28 is $\xi+\Delta\xi$.

Further, explanation will be made about the present embodiment in which the cross-sectional area of the downstream portion 28B is the formula $S=S_0+\Delta S$ (expanded in diameter) for convenience in view of explaining the following mathematical formula.

The frequency of the air column resonance caused in the tail pipe 28 is varied by correcting the downstream portion 28B of the tail pipe 28 with the formula $S=S_0+\Delta S$. The following formula (3) can be given for the variation of the air column resonance to be indicated as the variation ΔL of the tail pipe 28.

(Formula 1)

$$\Delta l = -\int_0^1 \cos\left(2m\pi\frac{\chi}{L}\right)\frac{\Delta S}{S_0}\,d\chi \tag{3}$$

(However, $m = 1, 2, 3, \ldots$)

Here, "m" represents primary, secondary, tertiary components of the frequency of the air column resonance.

Under the state that the air column resonance is caused in the tail pipe 28, the portions of the air column are repeatedly contracted and expanded to respectively perform motions different from one another, while the whole of the air column preserves the constant dynamic energy. This means that the following formula (3) is given.

Next, explanation will be made about the method to derive the foregoing formula (3).

First, the kinetic energy T is given. If the volume of air passing through the space having a cross-sectional area in the tail pipe per unit time is assumed to be "X", the particle speed is represented by the formula ξ=X/S. If the density of the air is represented by "$p_0$", the kinetic energy of the whole air in the tail pipe 28 can be represented by the following formula (4).

(Formula 2)

$$T = \frac{1}{2}\rho_0\int_0^1 \xi S\,d\chi = \frac{1}{2}\rho_0\int_0^1 \frac{X^2}{S}\,d\chi \tag{4}$$

Further, the potential energy P of the whole air in the tail pipe 28 can be represented by the following formula (5).

(Formula 3)

$$\begin{aligned} P &= \frac{1}{2}k\int_0^1 S^2\,d\chi \\ &= \frac{1}{2}\rho_0 c^2\int_0^1\left(\frac{\partial\xi}{\partial\chi}\right)^2 S\,d\chi \\ &= \frac{1}{2}\rho_0 c^2\int_0^1\left(\frac{\partial X}{\partial\chi}\right)^2\frac{d\chi}{S} \end{aligned} \tag{5}$$

Here, the symbols "c" (sonic speed) and "s" (condensation ratio of air) are respectively represented by the following formulas (6) and (7). The symbol "k" in the following formula (6) represents a volume elasticity ratio.

(Formula 4)

$$c = \sqrt{\frac{k}{\rho_0}} \tag{6}$$

(Formula 5)

$$s = -\frac{\partial\xi}{\partial\chi} \tag{7}$$

Under the state that the air column resonance is caused in the tail pipe 28, the dynamic energy of the whole air in the tail pipe 28 is considered to be at a constant level. This state is represented by the formula T+V=const, or by the following formula (8).

(Formula 6)

$$\frac{\partial}{\partial t}(T+P) = 0 \tag{8}$$

Here, X is varied in a sine form and thus can be represented by the following formula (9) which is combined with the formulas (4) and (5) for calculation. The formulas (4) and (5) are then combined with the formula (8) for solving "ω", which is then represented by the following formula (10).

(Formula 7)

$$X = \cos\left(m\pi\frac{\chi}{L}\right)\cdot\cos(\omega t) \tag{9}$$

(However, $m = 1, 2, 3, \ldots$)

-continued (Formula 8)

$$\omega^2 = \frac{m^2\pi^2c^2}{l^2} \cdot \frac{\int_0^1 \sin^2\left(m\pi\frac{\chi}{L}\right)\frac{d\chi}{S}}{\int_0^1 \cos^2\left(m\pi\frac{\chi}{L}\right)\frac{d\chi}{S}} \tag{10}$$

Here, the cross-sectional area is represented by the formula $S=S_0+\Delta S$ in which the variation amount $\Delta S$ is extremely small, so that the term of the second degree can be ignored for obtaining the approximation formula which is given by the following formula (11).

(Formula 9)

$$\omega^2 = \frac{m^2\pi^2c^2}{l}\left(1 + 2\int_0^1 \cos\left(2m\pi\frac{\chi}{L}\right)\frac{\Delta S}{S_0}\frac{d\chi}{L}\right) \tag{11}$$

From this formula, the frequency "f" of the air column resonance can be given with $s=\omega/2\pi$ by the following formula (12).

(Formula 10)

$$f = \frac{mc}{2\left(1 - \int_0^1 \cos\left(2m\pi\frac{\chi}{L}\right)\frac{\Delta S}{S_0}d\chi\right)} \tag{12}$$

Through the comparison of the above formula 12 with the formula 2 for obtaining the frequency of the air column resonance of the tail pipe 28, it is understood that the length of the tail pipe 28 is equivalently shorten by the formula (3).

The present embodiment is constructed with the volume per unit length of the exhaust passage 45*a* of the downstream portion 28B of the tail pipe 28 accommodating therein the short pipe 43 being smaller than the volume per unit length of the exhaust passage 45 of the tail pipe 28 with the downstream portion 28B removed therefrom.

In other words, the fact that the short pipe 43 is provided on the downstream portion 28B of the tail pipe 28 leads to the fact that the cross-sectional area of the exhaust passage 45*a* of the downstream portion 28B of the tail pipe 28 is reduced to be smaller than the cross-sectional area of the passage 45, thereby meaning that $\Delta S$ is "−" (minus).

Therefore, the minus $\Delta S$ means that the length of the tail pipe 28 is equivalent to the length of the tail pipe 28 lengthened by $\Delta L$, viz., plus $\Delta L$. The length $\Delta L$ makes it possible to make long the wavelength of the frequency of the air column resonance. It is thus to be noted that the frequency of the air column resonance of the tail pipe 28 can be lowered to the frequency of the air column resonance equal to the frequency of the air column resonance caused in the tail pipe 28 having a length longer by $\Delta L$ than the standard tail pipe 28.

When the tail pipe 28 is lengthened in a pseudo form, the potential energy A2 in the tail pipe 28 with no potential energy A1 accumulated in the short pipe 43 is distributed in the whole of the tail pipe 28 by the lengthened portion of the tail pipe 28 (elongated portion $\Delta L$), so that the tail pipe 28 lengthened in the pseudo form indicates to be equivalent to the tail pipe 28 slender in diameter from the standpoint of the dynamic energy.

Therefore, the potential energy of the air column resonance of the tail pipe 28 is finally reduced to have a level shown in hatchings A3 in FIG. 12 by the diameter portion of the tail pipe 28 slender in the pseudo form. This means that the peak of the sound pressure of the air column resonance can additionally be lowered to the peak A3 from the peak A in FIG. 12, thereby additionally lowering the sound pressure level.

Figure 15:
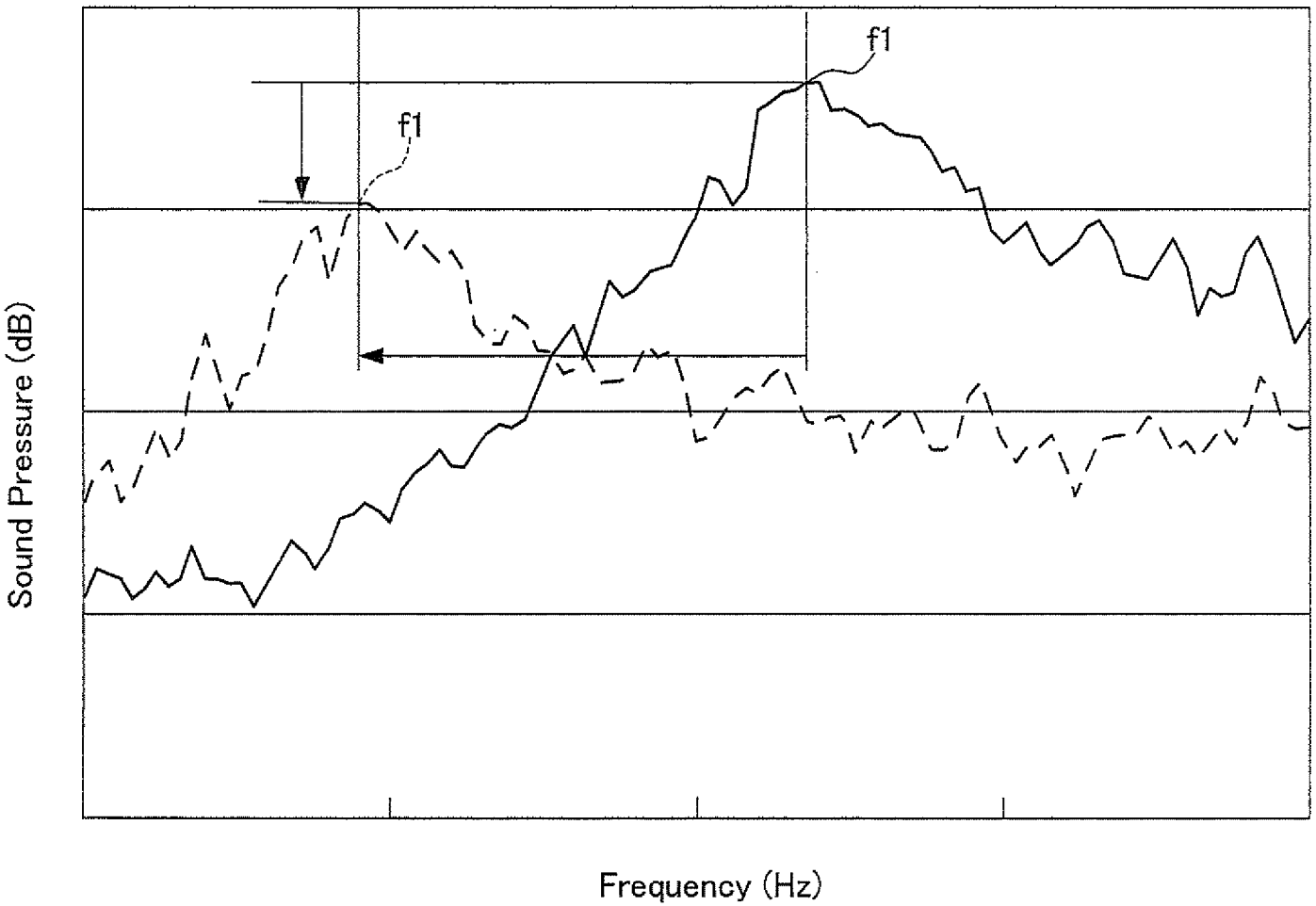
FIG. 15 is a view showing the first embodiment of the exhaust pipe part and the exhaust apparatus for the internal combustion engine according to the present invention, and a view showing the relationship between the sound pressure level of a primary component generated in the tail pipe and its frequency.

FIG. 15 is a graph showing the measurement results of the frequency of the exhaust gas pulsation and the sound pressure level (dB) of the exhaust gas sound when a speaker shaking test is conducted using a tail pipe having 12.5% of a reduction amount of the volume of the exhaust passage 45 accommodating therein the short pipe 43.

The solid line in FIG. 15 shows an exhaust gas pulsation in the tail pipe 28 with no short pipe 43 provided thereon, while the broken line in FIG. 15 shows an exhaust gas pulsation in the tail pipe 28 with a short pipe 43 provided thereon.

In the present embodiment as shown in FIG. 15, it is confirmed that the frequency of the primary component f1 of the air column resonance caused in the tail pipe can be lowered, and the sound pressure level of the primary component f1 can be lowered without fail.

Further, the results of the speaker shaking test conducted find that the minimum value of the reduction amount of the volume of the exhaust passage 45 of the tail pipe 28 capable of reducing the peak of the sound pressure and lowering the frequency of the air column resonance is 2.5%, and that it is impossible to expect the effect of reducing the sound pressure when the reduction amount of the volume of the exhaust passage 45 of the tail pipe 28 is less than 2.5%.

The present embodiment thus constructed is provided on the tail pipe 28 with an exhaust pipe part 41 forming part of the tail pipe 28. The exhaust pipe part 41 comprises a hollow member 42 connected with the tail pipe 28 in axial alignment with the tail pipe 28 to be positioned within an area covering a node portion in a sound pressure distribution of the air column resonance caused in the tail pipe 28, and a short pipe 43 provided in the hollow member 42 and having a predetermined length to extend in the axial direction of the tail pipe 28. The short pipe 43 has an open end 43*a* at the upstream end thereof, and a closed end 43*b* at the downstream end thereof, the closed end 43*b* being constituted by a bottom plate 43*b* positioned at the node portion in the sound pressure distribution of the standing wave of the air column resonance. The exhaust pipe part 41 thus constructed can distribute the potential energy A of the air column in the tail pipe 28 into the potential energy A1 in the short pipe 43 and the potential energy A2 in the tail pipe 28 with the short pipe 43 being removed therefrom at the node portion in the sound pressure distribution where the particle speed of the standing wave is at the maximum level when the air column resonance is caused in the tail pipe 28, so that only the potential energy A2 in the tail pipe 28 with the short pipe 43 being removed therefrom can be discharged to the outside, thereby making it possible to reduce the peak of the sound pressure. It is therefore possible to reduce the exhaust gas noises.

Further, the present embodiment is constructed in such a manner that the volume per unit length of the exhaust passage 45*a* of the downstream portion 28B of the tail pipe 28 is smaller than the volume per unit length of the exhaust passage 45 of the tail pipe 28 to throttle the exhaust passage 45 between the short pipe 43 and the lower portion 28B, so that the tail pipe 28 can be lengthened in a pseudo form. It is thus to be noted that the frequency of the air column resonance of the tail pipe 28 can be lowered to the frequency of the air column resonance equal to the frequency of the air column resonance caused in the tail pipe 28 long in length. Moreover, the potential energy A2 in the tail pipe 28 with no potential energy A1 accumulated in the short pipe 43 can be distributed in the whole of the tail pipe 28 by the lengthened portion of the tail pipe 28, thereby making it possible for the inner diameter of the tail pipe 28 to be made small in the pseudo form. For this reason, it is possible to additionally lower the peak of the sound pressure of the air column resonance and additionally reduce the sound pressure level of the air column resonance.

Figure 16:
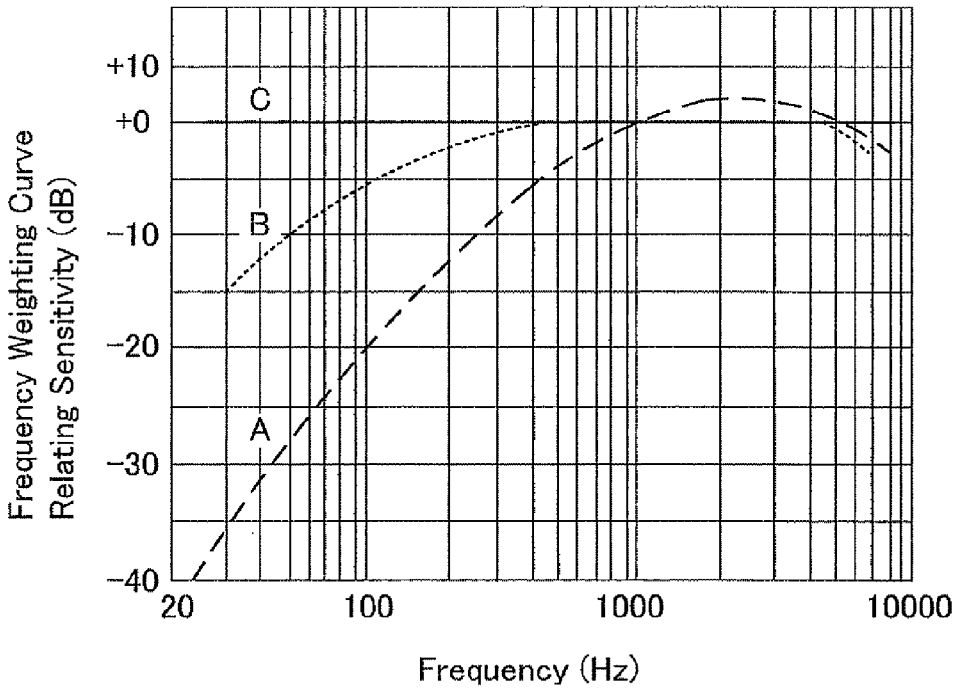
FIG. 16 is a view showing the first embodiment of the exhaust pipe part and the exhaust apparatus for the internal combustion engine according to the present invention, and showing a frequency weighting curve relating sensitivity for every frequency with a frequency.

The fact that the frequency of the air column resonance caused in the tail pipe 2 can be lowered to the frequency of the air column resonance equal to the frequency of the air column resonance caused in the tail pipe 28 long in length, leads to the fact that the frequency of the air column resonance can substantially be lowered by using an A-property (the property near the ears of human being) that people feel difficult to hear as the air column resonance becomes low in frequency (see FIG. 16).

The fact that the frequency of the air column resonance caused in the tail pipe 2 can be lowered to the frequency of the air column resonance equal to the frequency of the air column resonance caused in the tail pipe 28 long in length, leads to the fact that the rotation number of the engine 21 working as a sound source can be lowered to the low rotation range small in the rotation vibration of the engine 21 when the air column resonance is caused. In addition to this advantage, it is possible to drastically reduced the sound pressure level at the time of the air column resonance being caused, thereby resulting in drastically reducing the exhaust gas noises.

Especially, the present embodiment is constructed with the downstream open end 28*b* of the tail pipe 28 positioned at the node portion of the sound pressure distribution of the standing wave of the air column resonance, and with the downstream open end 28*b* being constituted by part of the exhaust pipe part 41, so that the peak of the sound pressure of the primary component f1 largest in the peaks of the sound pressure of the air column resonance can be reduced without fail as well as the frequency of the air column resonance of the primary component f1 can be lowered to the frequency of the air column resonance equal to the frequency of the air column resonance caused in the tail pipe 28 long in length, thereby making it possible to reduce the exhaust gas noises to an even lower level.

Additionally, the peak of the sound pressure of the secondary component f2 basing the primary component f1 of the air column resonance can be lowered, thereby making it possible to more drastically reduce the exhaust gas noises in the normal rotation area of the engine 21. More specifically, the peak of the sound pressure of the primary component f1 of the air column resonance, and the peak of the sound pressure of the secondary component f2 of the air column resonance can respectively be decreased from the positions shown by the dotted lines to the positions shown by the solid lines in FIG. 8, thereby making it possible to drastically decrease the exhaust gas noises.

It will therefore be appreciated that the present embodiment of the present invention can make unnecessary the muffler used in the conventional vehicle, and make unnecessary the resonance chamber 36 large in volume, thereby resulting in the muffler made small in size. For this reason, the embodiment of the present invention not only can reduce the weight of the exhaust apparatus 23 but also can decrease the production cost of the exhaust apparatus 23.

The short pipe 43 forming part of the present embodiment is set to have a length $\frac{1}{8}\cdot\times\lambda$ with respect to the wave length $\lambda$ of the standing wave of the air column resonance, and the bottom plate 43*b* of the short pipe 43 is positioned at the node portion of the sound pressure distribution of the standing wave of the air column resonance caused in the tail pipe 28, so that it is possible to position the short pipe 43 at the position large in the particle speed of the standing wave of the air column resonance, thereby making it possible to more effectively enlarge the kinetic energy of the exhaust gas in the tail pipe 28 with respect to the reduction amount of the potential energy.

In contrast, the short pipe 43 set to have a length more than the length $\frac{1}{8}\times\cdot\lambda$ with respect to the wave length $\lambda$ of the standing wave of the air column resonance leads to the short pipe 43 partly positioned at the position large in the potential energy and small in the particle speed, so that the increased amount of the kinetic energy in the tail pipe 28 cannot be enlarged with respect to the reduced amount of the potential energy in the tail pipe 28, thereby resulting in the reduction of the dynamic energy in the tail pipe 28.

For this reason, it is therefore not preferable that the tail pipe 28 shortened in the pseudo form leads to raising the frequency of the air column resonance. This means that the length of the short pipe 43 is preferably set to the length less than or equal to $\frac{1}{8}\cdot\times\lambda$ with respect to the wave length $\lambda$ of the standing wave of the air column resonance.

Further, the present embodiment has been explained with the tail pipe 28 which is constituted by the pipe body 40 and the exhaust pipe part 41, however, the tail pipe 28 may be constructed by a single tail pipe having the pipe body 40 and the exhaust pipe part 41 integrally formed with each other. The pipe body 40 and the exhaust pipe part 41 integrally formed with each other leads to no need to separately produce the pipe body 40 and the exhaust pipe part 41, and then to assemble the exhaust pipe part 41 with the pipe body 40, thereby making it possible to facilitate the production of the tail pipe as well as to reduce the production cost of the tail pipe.

Figure 17:
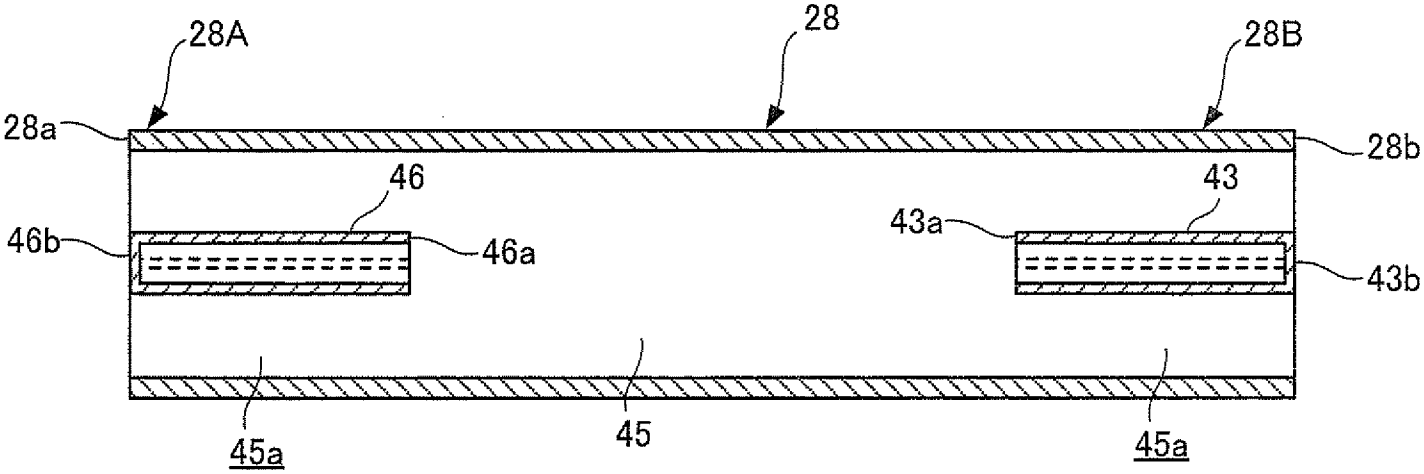
FIG. 17 is a view showing the first embodiment of the exhaust pipe part and the exhaust apparatus for the internal combustion engine according to the present invention, and a cross-sectional view of the tail pipe having an upstream portion and a downstream portion each having a short pipe provided thereon.

Further, the present embodiment has been explained with the exhaust pipe part 41 which constitutes the downstream portion 28B of the tail pipe 28, however, the present invention is not limited to this construction. The present invention may include such a construction as having short pipes 43 and 46 respectively accommodated in the upstream portion 28A and the downstream portion 28B of the integrally formed tail pipe 28 to be positioned in the areas covering the node portions of the sound pressure distributions of the air column resonances as shown in FIG. 17.

In this case, the bottom plate 46*b* of the tail pipe 46 is positioned at the node portion of the sound pressure distribution of the standing wave of the air column resonance caused in the tail pipe 28, and the open end 46*a* of the short pipe 46 is axially spaced apart from the bottom plate 46*b* toward the downstream open end 28*b*, so that the volume per unit length of the exhaust passage 45*a* of the upstream portion 28A of the tail pipe 28 can be made smaller than the volume per unit length of the exhaust passage 45 of the tail pipe 28.

In this manner, the reduced volumes per unit length of both of the upstream portion 28A and the downstream portion 28B of the tail pipe 28 make it possible to more drastically reduce the potential energy of the air column resonance caused in the tail pipe 28, and to increase the dynamic energy to the even higher level by raising the particle speeds of the standing waves of the air column resonances caused in both of the upstream portion 28A and the downstream portion 28B of the tail pipe 28.

According to the present invention, it may be possible to provide a short pipe 46 only in the upstream portion 28A of the tail pipe 28 to reduce the volume per unit length of the exhaust passage 45*a* in the upstream portion 28A of the tail pipe 28 to the level smaller than the volume per unit length of the exhaust passage 45 of the tail pipe 28. This construction having the short pipe 46 only in the upstream portion 28A of the tail pipe 28 can attain the same effects as those of the construction having the short pipe only in the downstream portion 28B of the tail pipe 28.

The present embodiment may be constructed to have the upstream portion 28A of the tail pipe 28 constituted by the exhaust pipe part 41 separate from the pipe body 40, the upstream open end of the hollow member 42 of the exhaust pipe part 41 constituting the upstream open end 28*a* of the tail pipe 28.

(Second Embodiment)

Figure 18:
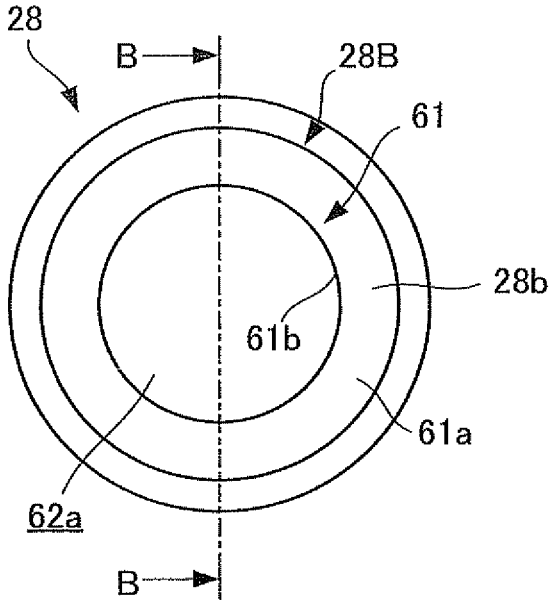
FIG. 18 is a view showing a second embodiment of the exhaust pipe part and the exhaust apparatus for the internal combustion engine according to the present invention, and a front view of the tail pipe seen from the axial direction thereof.
Figure 19:
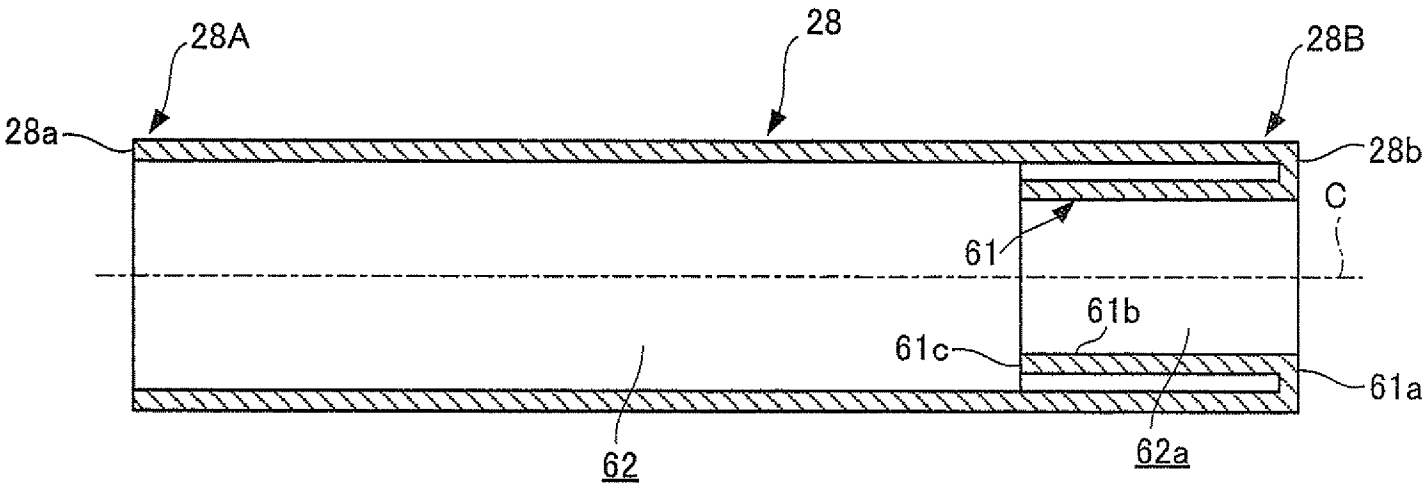
FIG. 19 is a cross-sectional view of the tail pipe taken along and seen from the line B-B of FIG. 18.
Figure 20:
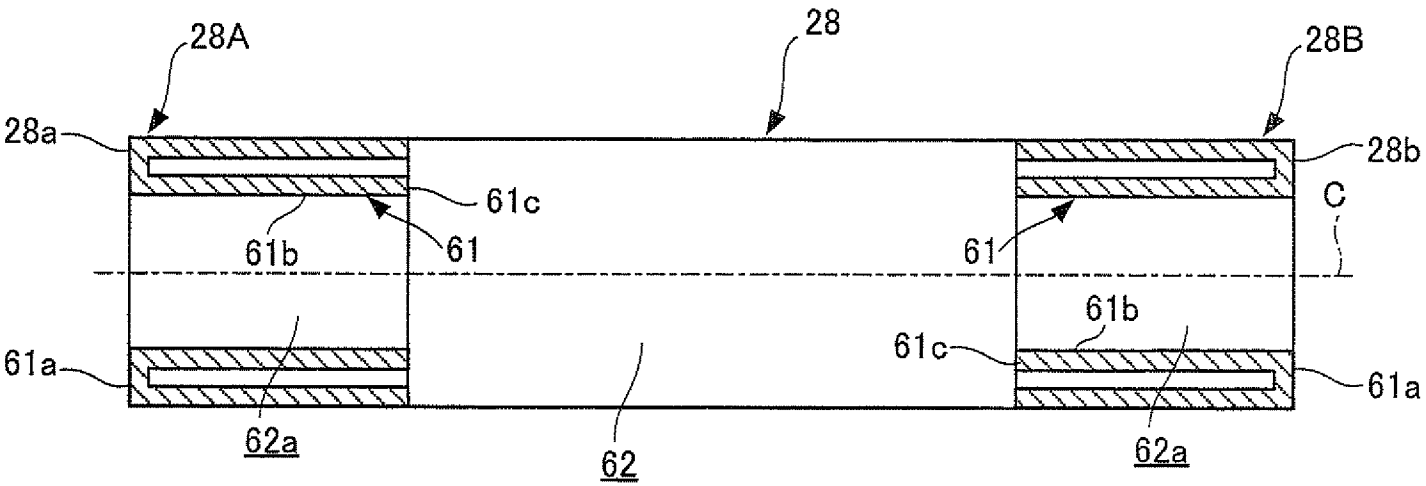
FIG. 20 is a view showing the second embodiment of the exhaust pipe part and the exhaust apparatus for the internal combustion engine according to the present invention, and a cross-sectional view of the tail pipe having the upstream portion and the downstream portion each having a short pipe provided thereon.

FIGS. 18 to 19 are views respectively showing a second embodiment of the exhaust pipe part and the exhaust apparatus for the internal combustion engine according to the present invention. The constitution parts and elements forming the second embodiment the same as those of the first embodiment bear the same reference numerals as those of the first embodiment, and will be omitted from being explained hereinafter to avoid tedious repetition therefor.

As shown in FIGS. 18 and 19, the short pipe 61 has a bottom plate 61*a*, and an annular member 61*b*. The bottom plate 61*a* forms a closed end and is bent from the downstream open end 28*b* of the downstream portion 28B of the tail pipe 28 toward the center axis C of the tail pipe 28. The annular member 61*b* is bent from the bottom plate 61*a* toward the upstream open end 28*a* of the tail pipe 28 to extend in parallel with the tail pipe 28, and constitutes the open end 61*c* together with the downstream portion 28B of the tail pipe 28 at the upstream end of the short pipe 61. It is therefore to be noted that the short pipe 61 is integrally formed with the downstream portion 28B and is thus in a bottomed cylindrical shape.

In the tail pipe 28 forming part of the present embodiment, the downstream portion 28B constitutes the hollow member defined in the present invention. The hollow member and the short pipe 61 are integrally formed with the tail pipe 28 which is made of only one single pipe.

Further, the downstream portion 28B of the tail pipe 28 may be constituted by a hollow member separate from the tail pipe 28, and the downstream portion 28B constituted by the hollow member and the short pipe 61 may form the exhaust pipe part which is to be attached to the tail pipe 28.

In the case of the downstream portion 28B constituted by the exhaust gas pipe part, the downstream portion 28B remaining in the state of being removed from the tail pipe 28 is provided with a bottom plate 61*a* and an annular member 61*b*. The bottom plate 61*a* forms a closed end and is bent toward the center axis C of the tail pipe 28 from the downstream open end 28*b* of the downstream portion 28B of the tail pipe 28. The annular member 61*b* is bent toward the axial other end of the downstream portion 28B of the tail pipe 28 from the bottom plate 61*a* to extend in parallel with the downstream portion 28B of the tail pipe 28.

On the other hand, the bottom plate 61*a* of the short pipe 61 at the axial one end of the short pipe 61 is positioned in coplanar relationship with the downstream open end 28*b*, while the annular member 61*b* of the short pipe 61 extends toward the upstream open end 28*a* from the bottom plate 61*a*. The standing wave of the air column resonance caused in the tail pipe 28 has a wave length λ. The short pipe 61 forming part of the present embodiment is set to have a length ⅛·×λ with respect to the wave length λ of the standing wave of the air column resonance, viz., set to have a length equal to ¼ the length L of the tail pipe 28.

Further, the short pipe 61 may be set to have a length less than ⅛·×λ, viz., set to have a length less than ¼ the length L of the tail pipe 28.

The present embodiment is constructed with the bottom plate 61*a* of the short pipe 61 at the axial one end of the short pipe 61 being positioned in coplanar relationship with the downstream open end 28*b*, so that the bottom plate 61*a* of the short pipe 61 is positioned at the node portion of the standing wave in the sound pressure distribution of the air column resonance caused in the tail pipe 28. Here, the bottom plate 61*a* of the short pipe 61 may be somewhat displaced to the upstream side or the downstream side from the node portion of the sound pressure distribution.

Further, the volume of the exhaust passage 62*a* is reduced in such a manner that the volume per unit length of the exhaust passage 62*a* of the downstream portion 28B is smaller than the volume per unit length of the exhaust passage 62 of the tail pipe 28.

The short pipe 61 has a size set in such a manner that the volume of the exhaust passage 62 of the tail pipe 61 at the time of the short pipe 61 being provided in the tail pipe 28*a* is reduced from the volume of the exhaust passage 62 of the tail pipe 28 at the time of the short pipe 61 being not provided in the tail pipe 28 by a volume reduction amount of more than or equal to 2.5% of the volume of the exhaust passage 62 of the tail pipe 28 at the time of the short pipe 61 being not provided in the tail pipe 28.

The exhaust passage 62 indicates the whole space surrounded by the tail pipe 28, while the exhaust passage 62*a* is constituted by a space surrounded by the inner peripheral surface portion of the annular member 61*b* in the exhaust passage 62.

The tail pipe 28 having the short pipe 61 thus constructed has therein a potential energy A which is distributed into a potential energy A1 in the short pipe 61 and a potential energy A2 in the tail pipe 28 with no short pipe 61, so that only the potential energy A2 with no short pipe 61 is discharged to the outside, thereby making it possible to reduce the peak of the sound pressure.

Further, the present embodiment is constructed in such a manner that the tail pipe 28 is lengthened in a pseudo form to have the frequency of the air column resonance of the tail pipe 28 lowered to the frequency of the air column resonance equal to the frequency of the air column resonance caused in the tail pipe 28 long in length. Moreover, the potential energy can be distributed in the whole of the tail pipe 28 by the lengthened portion of the tail pipe 28, thereby making it possible for the inner diameter of the tail pipe 28 to be made small in the pseudo form. For this reason, it is possible to additionally lower the peak of the sound pressure of the air column resonance and additionally reduce the sound pressure level of the air column resonance.

As a consequence, the second embodiment of the present invention can reduce the exhaust noises in the same manner as that of the first embodiment and can make unnecessary the muffler used in the conventional vehicle, and make the muffler 27 small in size. Moreover, the second embodiment of the present invention not only can reduce the weight of the exhaust apparatus 23 but also can decrease the production cost of the exhaust apparatus 23.

Further, in the present embodiment, the short pipe 61 is constituted by the bottom plate 61*a* and the annular member 61*b*, the bottom plate 61*a* being bent from the downstream open end 28*b* of the tail pipe 28, so that it can be unnecessary to provide any brackets for securing the short pipe 61 to the inner peripheral portion of the tail pipe 28. Therefore, the production cost of the tail pipe 28 can be reduced as well as the tail pipe 28 can be made light in weight.

Further, the present embodiment has been explained with the short pipe 61 provided on the downstream portion 28B of the tail pipe 28, however, the present invention is not limited to this construction. The present invention may include constructions one of which has the short pipe provided on the upstream portion 28A of the tail pipe 28, and the other which has the short pipes 61 provided on the upstream portion 28A and the downstream portion 28B of the tail pipe 28, respectively, Especially with the short pipes provided at the both of the upstream portion 28A and the downstream portion 28B of the tail pipe 28, it is possible to reduce the potential energy of the air column resonance caused in the tail pipe 28 to an even smaller level, and to raise the particle speed of the standing wave of the air column resonance at the both of the upstream portion 28A and the downstream portion 28B of the tail pipe 28, thereby making it possible to increase kinetic energy to an even larger level.

(Third Embodiment)

Figure 21:
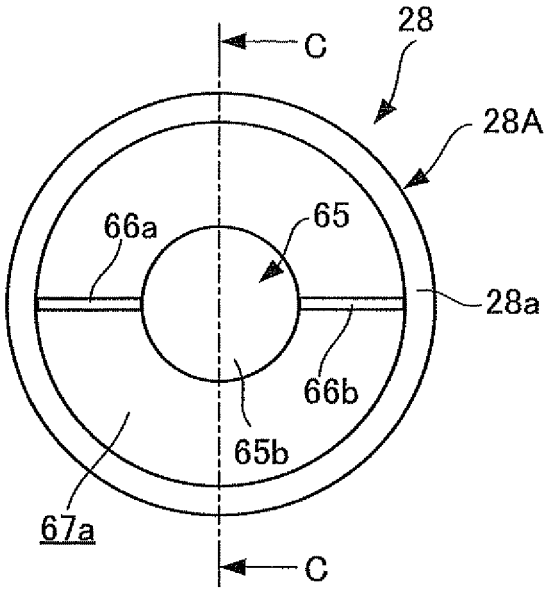
FIG. 21 is a view showing a third embodiment of the exhaust pipe part and the exhaust apparatus for the internal combustion engine according to the present invention, and a front view of the tail pipe seen from the axial direction thereof.
Figure 22:
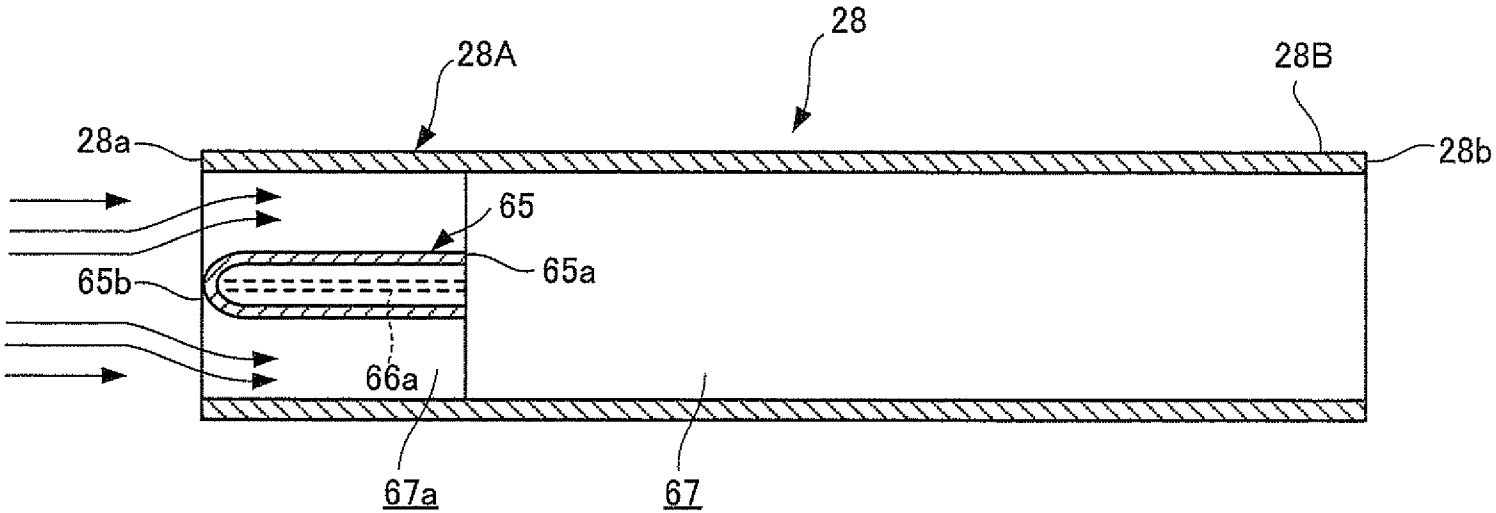
FIG. 22 is a cross-sectional view of the tail pipe taken along and seen from the line C-C of FIG. 21.

FIGS. 21 to 22 are views respectively showing a third embodiment of the exhaust pipe part and the exhaust apparatus for the internal combustion engine according to the present invention. The constitution parts and elements forming the third embodiment the same as those of the first embodiment bear the same reference numerals as those of the first embodiment, and will be omitted from being explained hereinafter to avoid tedious repetition therefor.

As shown in FIGS. 21 and 22, there is provided a short pipe 65 in the inner portion of the upstream portion 28A of the tail pipe 28. The short pipe 65 is secured to the upstream portion 28A of the tail pipe 28 through the brackets 66*a*, 66*b*. The short pipe 65 is disposed on the center axis of the tail pipe, viz., the center axis of the short pipe 65 is in coaxial relationship with the center axis of the tail pipe 28.

The short pipe 65 has at its downstream end an open end 65*a* forming an axial other end, and at its upstream end a closed end, i.e., a bottom plate 65*b* forming an axial one end. The short pipe 65 is formed in a bottomed cylindrical shape to extend in the axial direction of the tail pipe 28, and has a predetermined length.

The bottom plate 65*b* of the short pipe 65 is formed to have a spherical surface or a parabolic surface. Further, the short pipe 65 is formed to have a cross-sectional area near the bottom plate 65*b* smaller than the cross-sectional area near the open end 65*a*.

The upstream portion 28A of the tail pipe 28 in the present embodiment constitutes a hollow member. The hollow member is integrally formed with the tail pipe 28 which is made of a single pipe.

Further, the upstream portion 28A of the tail pipe 28 may be constituted by a hollow member separate from the tail pipe 28, the upstream portion 28A constituted by the hollow member and the short pipe 65 collectively constituting the exhaust pipe part which is to be attached to the tail pipe 28.

The present embodiment is constructed with the bottom plate 65*b* of the short pipe 65 being positioned in coplanar relationship with the upstream open end 28*a*, so that the bottom plate 65*b* of the short pipe 65 is positioned at the node portion of the standing wave of the sound pressure distribution of the air column resonance caused in the tail pipe 28. Here, the bottom plate 65*b* of the short pipe 65 may be somewhat displaced to the upstream side or the downstream side from the node portion of the sound pressure distribution.

The standing wave of the air column resonance caused in the tail pipe 28 has a wave length λ. The short pipe 65 forming part of the present embodiment is set to have a length ⅛·×λ with respect to the wave length λ of the standing wave of the air column resonance, viz., set to have a length equal to ¼ the length L of the tail pipe 28. The above short pipe 65 may be set to have a length less than ⅛·λm with respect to the wave length X of the standing wave of the air column resonance, viz., set to have a length less than ¼ the length L of the tail pipe 28.

Further, in the present embodiment, the volume of the exhaust passage 67*a* is reduced in such a manner that the volume per unit length of the exhaust passage 67*a* of the downstream portion 28B is smaller than the volume per unit length of the exhaust passage 67 of the tail pipe 28.

More specifically, the short pipe 65 has a size set in such a manner that the reduction amount of the volume of the exhaust passage 67 of the tail pipe 28 when the short pipe 65 is provided in the tail pipe 28 with respect to the volume of the exhaust passage 67 of the tail pipe 28 when the short pipe 65 is not provided in the tail pipe 28 is more than or equal to 2.5% of the volume of the exhaust passage 67 of the tail pipe 28 when the short pipe 65 is not provided in the tail pipe 28.

Further, the exhaust passage 67 indicates the whole space surrounded by the tail pipe 28, and the exhaust passage 67*a* is constituted by a space surrounded by the outer peripheral portion of the short pipe 65 and the inner peripheral portion of the downstream portion 28B of the tail pipe 28 in the exhaust passage 67.

The tail pipe 28 having the short pipe 65 thus constructed has therein a potential energy A which is distributed into a potential energy A1 in the short pipe 65 and a potential energy A2 in the tail pipe 28 with no short pipe 65, so that only the potential energy A2 with no short pipe 65 is discharged to the outside, thereby making it possible to reduce the peak of the sound pressure.

The tail pipe 28 is lengthened in a pseudo form to have the frequency of the air column resonance of the tail pipe 28 lowered to the frequency of the air column resonance equal to the frequency of the air column resonance caused in the tail pipe 28 long in length. Moreover, the potential energy can be distributed in the whole of the tail pipe 28 by the lengthened portion of the tail pipe 28, thereby making it possible for the inner diameter of the tail pipe 28 to be made small in the pseudo form. For this reason, it is possible to additionally lower the peak of the sound pressure of the air column resonance and additionally reduce the sound pressure level of the air column resonance.

As a consequence, the third embodiment of the present invention can reduce the exhaust noises in the same manner as that of the first embodiment and can make unnecessary the muffler used in the conventional vehicle, and make the muffler 27 small in size. Moreover, the third embodiment of the present invention not only can reduce the weight of the exhaust apparatus 23 but also can decrease the production cost of the exhaust apparatus 23.

Further, the present embodiment thus constructed have the bottom plate 65*b* of the short pipe 65 formed in a spherical or parabolic shape, so that the exhaust gas collided with the bottom plate 65*b* of the short pipe 65 can be guided along the spherical or parabolic shape to the exhaust passage 67*a*, while preventing the short pipe 65 from resisting the smooth flow of the exhaust gas, and preventing the back pressure of the exhaust gas flowing in the tail pipe 28 from being raised. Additionally, it is possible to rectify the exhaust gas from the upstream outer portion of the short pipe 65 toward the downstream outer portion of the short pipe 65, thereby making it possible to prevent a turbulent flow from being caused in the tail pipe 28, and to prevent flow noises from being caused in the tail pipe 28.

(Fourth Embodiment)

Figure 23:
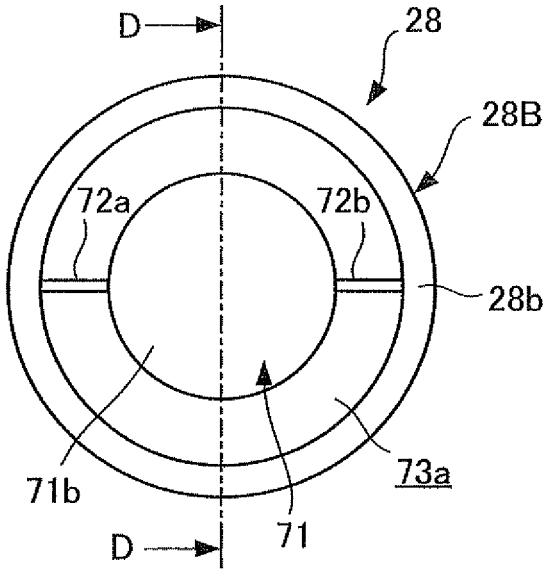
FIG. 23 is a view showing a fourth embodiment of the exhaust pipe part and the exhaust apparatus for the internal combustion engine according to the present invention, and a front view of the tail pipe seen from the axial direction thereof.
Figure 24:
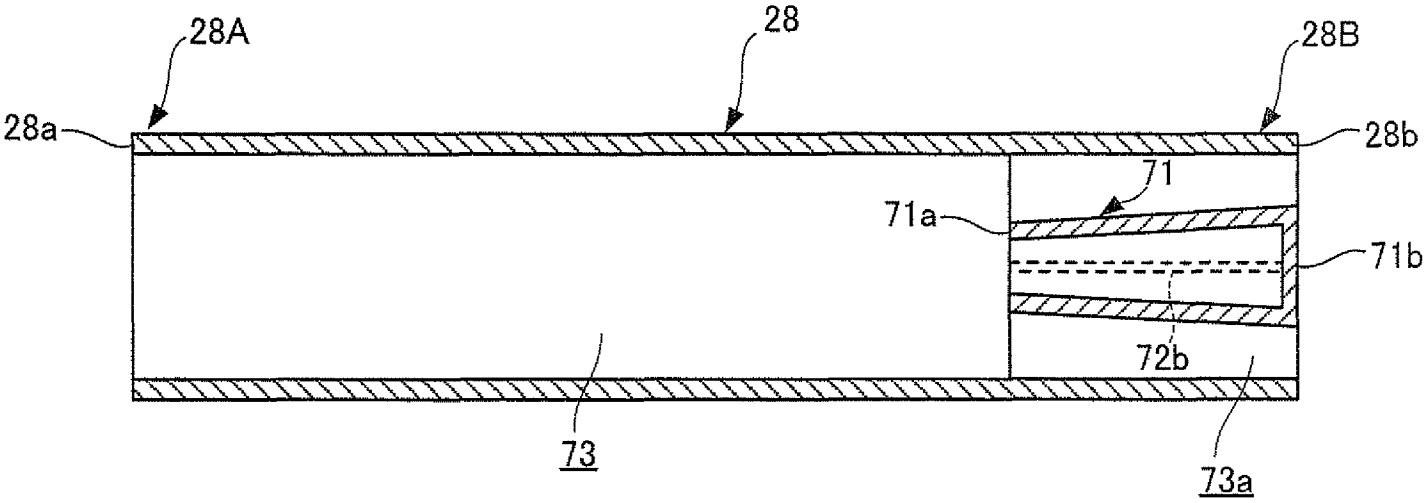
FIG. 24 is a cross-sectional view of the tail pipe taken along and seen from the line D-D of FIG. 23.

FIGS. 23 to 24 are views respectively showing a fourth embodiment of the exhaust pipe part and the exhaust apparatus for the internal combustion engine according to the present invention. The constitution parts and elements forming the fourth embodiment the same as those of the first embodiment bear the same reference numerals as those of the first embodiment, and will be omitted from being explained hereinafter to avoid tedious repetition therefor.

As shown in FIGS. 23 and 24, there is provided a short pipe 71 in the inner portion of the downstream portion 28B of the tail pipe 28. The short pipe 71 is secured to the downstream portion 28B of the tail pipe 28 through the brackets 72*a*, 72*b*. The short pipe 71 is disposed on the center axis of the tail pipe 28, viz., the center axis of the short pipe 71 is in coaxial relationship with the center axis of the tail pipe 28.

The short pipe 71 has at its upstream end an open end 71*a* forming an axial other end, and at its downstream end a closed end, i.e., a bottom plate 71*b* forming an axial one end. The short pipe 71 is formed in a bottomed cylindrical shape extending in the axial direction of the tail pipe 28 and having a predetermined length.

Further, the short pipe 71 is formed to have a cross-sectional area near the bottom plate 71*b* larger (claims 8 and 9) than the cross-sectional area near the open end 71*a*. The short pipe 71 forming part of the present embodiment is formed to have the cross-sectional area gradually decreased from the bottom plate 71*b* toward the open end 71*a*.

The upstream portion 28B of the tail pipe 28 in the present embodiment constitutes a hollow member. The hollow member is integrally formed with the tail pipe 28 which is made of a single pipe.

Further, the downstream portion 28B of the tail pipe 28 may be constituted by a hollow member separate from the tail pipe 28, the downstream portion 28B constituted by the hollow member and the short pipe 61 collectively constituting the exhaust pipe part which is to be attached to the tail pipe 28.

The present embodiment is constructed with the bottom plate 71*b* of the short pipe 71 at the axial one end of the short pipe 71 being positioned in coplanar relationship with the downstream open end 28*b*, so that the bottom plate 71*b* of the short pipe 71 is positioned at the node portion of the standing wave in the sound pressure distribution of the air column resonance caused in the tail pipe 28. Here, the bottom plate 71*b* of the short pipe 71 may be somewhat displaced to the upstream side or the downstream side from the node portion of the sound pressure distribution.

The standing wave of the air column resonance caused in the tail pipe 28 has a wave length λ. The short pipe 71 forming part of the present embodiment is set to have a length ⅛·×λ with respect to the wave length λof the standing wave of the air column resonance, viz., set to have a length equal to ¼ the length L of the tail pipe 28. The above short pipe 71 may be set to have a length less than ⅛·×λ with respect to the wave length λ of the standing wave of the air column resonance, viz., set to have a length less than ¼ the length L of the tail pipe 28.

Further, in the present embodiment, the volume per unit length of the exhaust passage 73*a* of the downstream portion 28B of the tail pipe 28 having the short pipe 71 supported thereon is smaller than the volume per unit length of the exhaust passage 73 of the tail pipe 28 with the above downstream portion 28B removed from the tail pipe 28.

More specifically, the short pipe 71 has a size set in such a manner that the reduction amount of the volume of the exhaust passage 73 of the tail pipe 28 when the short pipe 71 is provided in the tail pipe 28 with respect to the volume of the exhaust passage 73 of the tail pipe 28 when the short pipe 71 is not provided in the tail pipe 28 is more than or equal to 2.5% of the volume of the exhaust passage 73 of the tail pipe 28 when the short pipe 71 is not provided in the tail pipe 28.

Further, the exhaust passage 73 indicates the whole space surrounded by the tail pipe 28, and the exhaust passage 73*a* is constituted by a space surrounded by the outer peripheral portion of the short pipe 71 and the inner peripheral portion of the downstream portion 28B of the tail pipe 28 in the exhaust passage 73.

The tail pipe 28 having the short pipe 71 thus constructed has therein a potential energy A which is distributed into a potential energy A1 in the short pipe 71 and a potential energy A2 in the tail pipe 28 with no short pipe 71, so that only the potential energy A2 with no short pipe 71 is discharged to the outside, thereby making it possible to reduce the peak of the sound pressure.

The tail pipe 28 is lengthened in a pseudo form to have the frequency of the air column resonance of the tail pipe 28 lowered to the frequency of the air column resonance equal to the frequency of the air column resonance caused in the tail pipe 28 long in length. Moreover, the potential energy can be distributed in the whole of the tail pipe 28 by the lengthened portion of the tail pipe 28, thereby making it possible for the inner diameter of the tail pipe 28 to be made small in the pseudo form. For this reason, it is possible to additionally lower the peak of the sound pressure of the air column resonance and additionally reduce the sound pressure level of the air column resonance.

As a consequence, the fourth embodiment of the present invention can reduce the exhaust noises in the same manner as that of the first embodiment and can make unnecessary the muffler used in the conventional vehicle, and make the muffler 27 small in size. Moreover, the fourth embodiment of the present invention not only can reduce the weight of the exhaust apparatus 23 but also can decrease the production cost of the exhaust apparatus 23.

The short pipe 71 forming part of the present embodiment is formed to have the cross-sectional area gradually increased from the bottom plate 71*b* toward the open end 71*a*, so that the downstream portion 28B of the tail pipe 28 can be formed to have the upstream side cross-sectional area of the exhaust passage 73*a* larger than the downstream side cross-sectional area of the exhaust passage 73*a*. For this reason, it is possible to prevent the short pipe 71 from resisting the smooth flow of the exhaust gas, and to prevent the back pressure of the exhaust gas flowing in the tail pipe 28 from being raised.

(Fifth Embodiment)

Figure 25:
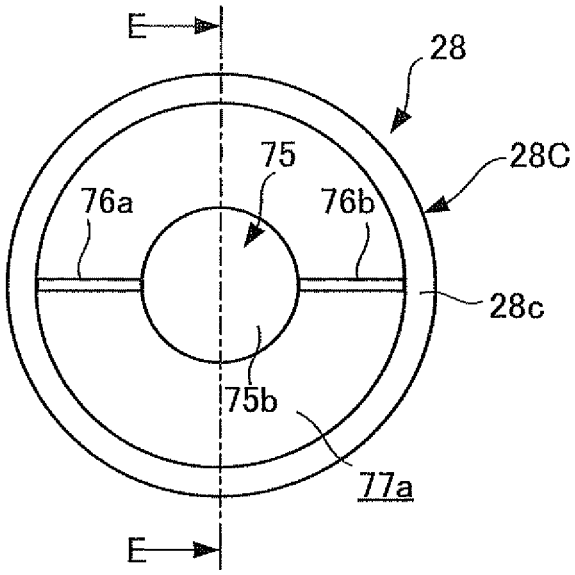
FIG. 25 is a view showing a fifth embodiment of the exhaust pipe part and the exhaust apparatus for the internal combustion engine according to the present invention, and a front view of the tail pipe seen from the axial direction thereof.
Figure 26:
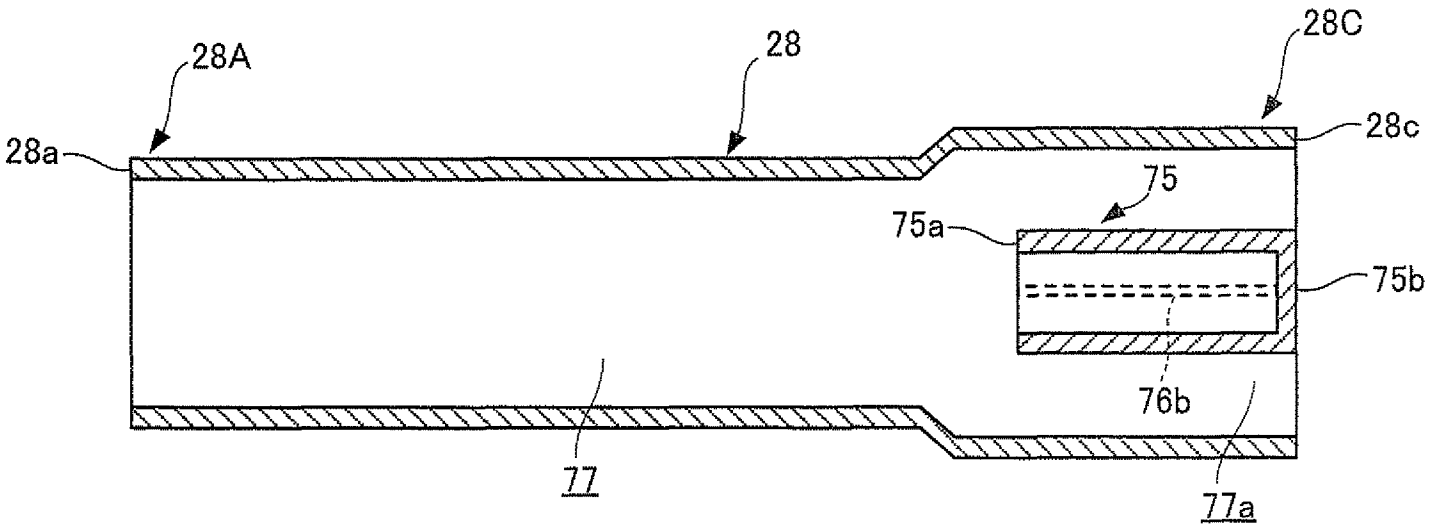
FIG. 26 is a cross-sectional view of the tail pipe taken along and seen from the line E-E of FIG. 25.

FIGS. 25 to 26 are views respectively showing a fifth embodiment of the exhaust pipe part and the exhaust apparatus for the internal combustion engine according to the present invention. The constitution parts and elements forming the fifth embodiment the same as those of the first embodiment bear the same reference numerals as those of the first embodiment, and will be omitted from being explained hereinafter to avoid tedious repetition therefor.

As shown in FIGS. 25 and 26, there is provided a short pipe 75 in the inner portion of the downstream portion 28C of the tail pipe 28 expanded in diameter. The short pipe 75 is secured to the downstream portion 28C of the tail pipe 28 through the brackets 76*a*, 76*b*. The short pipe 75 is disposed on the center axis of the tail pipe 28, viz., the center axis of the short pipe 75 is in coaxial relationship with the center axis of the tail pipe 28.

The short pipe 75 has at its upstream end an open end 75*a* forming an axial other end, and at its downstream end a closed end, i.e., a bottom plate 75*b* forming an axial one end. The short pipe 75 is formed in a bottomed cylindrical shape extending in the axial direction of the tail pipe 28 and having a predetermined length.

The downstream portion 28C of the tail pipe 28 in the present embodiment constitutes a hollow member. The hollow member is integrally formed with the tail pipe 28 which is made of a single pipe.

Further, the downstream portion 28C of the tail pipe 28 may be constituted by a hollow member separate from the tail pipe 28, the downstream portion 28C constituted by the hollow member and the short pipe 75 collectively constituting the exhaust pipe part which is to be attached to the tail pipe 28.

The present embodiment is constructed with the bottom plate 75*b* of the short pipe 75 at the axial one end of the short pipe 75 being positioned in coplanar relationship with the downstream open end 28*c*, so that the bottom plate 75*b* of the short pipe 75 is positioned at the node portion of the standing wave in the sound pressure distribution of the air column resonance caused in the tail pipe 28. Here, the bottom plate 75*b* of the short pipe 75 may be somewhat displaced toward the upstream side or the downstream side from the node portion of the sound pressure distribution.

The standing wave of the air column resonance caused in the tail pipe 28 has a wave length λ. The short pipe 75 forming part of the present embodiment is set to have a length ⅛·×λ with respect to the wave length λ of the standing wave of the air column resonance, viz., set to have a length equal to ¼ the length L of the tail pipe 28. The above short pipe 75 may be set to have a length less than ⅛·×λ with respect to the wave length λ of the standing wave of the air column resonance, viz., set to have a length less than ¼ the length L of the tail pipe 28.

Further, in the present embodiment, the downstream portion 28C is expanded in diameter in such a manner that the cross-sectional area of the exhaust passage 77*a* of the downstream portion 28C of the tail pipe 28 having the short pipe 75 supported thereon is the same as the cross-sectional area of the exhaust passage 77 of the downstream portion 28C of the tail pipe 28 having the short pipe 75 removed thereof. The downstream portion 28C of the tail pipe 28 partly has a tapered portion. The above expansion of the downstream portion 28C is required to be considered by excluding the cross-sectional area surrounded by the tapered portion.

Further, the exhaust passage 77 indicates the whole space surrounded by the tail pipe 28, and the exhaust passage 77*a* is constituted by a space surrounded by the outer peripheral portion of the short pipe 75 and the inner peripheral portion of the downstream portion 28C of the tail pipe 28 in the exhaust passage 77.

The tail pipe 28 having the short pipe 75 thus constructed has therein a potential energy A which is distributed into a potential energy A1 in the short pipe 75 and a potential energy A2 in the tail pipe 28 with no short pipe 75, so that only the potential energy A2 with no short pipe 75 is discharged to the outside, thereby making it possible to reduce the peak of the sound pressure as well as to lower the sound pressure level.

As a consequence, the fifth embodiment of the present invention can reduce the exhaust noises in the same manner as that of the first embodiment and can make unnecessary the muffler used in the conventional vehicle, and make the muffler 27 small in size. Moreover, the fifth embodiment of the present invention not only can reduce the weight of the exhaust apparatus 23 but also can decrease the production cost of the exhaust apparatus 23.

Further, in the present embodiment, the downstream portion 28C of the tail pipe 28 is expanded in diameter in such a manner that the cross-sectional area of the exhaust passage 77*a* of the downstream portion 28C of the tail pipe 28 having the short pipe 75 supported thereon is the same as the cross-sectional area of the exhaust passage 77 of the tail pipe 28 with the downstream portion 28C removed therefrom. However, the downstream portion 28C of the tail pipe 28 may be expanded in diameter in such a manner that the volume per unit length of the exhaust passage 77*a* of the downstream portion 28C of the tail pipe 28 having the short pipe 75 supported thereon is smaller than the volume per unit length of the exhaust passage 77 of the tail pipe 28 with the downstream portion 28C removed therefrom.

In this case, the short pipe 75 is required to have a size set in such a manner that the reduction amount of the volume of the exhaust passage 77 of the tail pipe 28 when the short pipe 75 is provided in the tail pipe 28 with respect to the volume of the exhaust passage 77 of the tail pipe 28 when the short pipe 75 is not provided in the tail pipe 28 is more than or equal to 2.5% of the volume of the exhaust passage 77 of the tail pipe 28 when the short pipe 75 is not provided in the tail pipe 28.

With this construction in the above, the tail pipe 28 can be lengthened in a pseudo form to have the frequency of the air column resonance of the tail pipe 28 lowered to the frequency of the air column resonance equal to the frequency of the air column resonance caused in the lengthened tail pipe 28. Moreover, the potential energy can be distributed in the whole of the tail pipe 28 by the lengthened portion of the tail pipe 28, thereby making it possible for the inner diameter of the tail pipe 28 to be made small in the pseudo form. For this reason, it is possible to additionally lower the peak of the sound pressure of the air column resonance and additionally reduce the sound pressure level of the air column resonance. The fifth embodiment can attain the same effects as those of the first embodiment.

Although the downstream portion 28C of the tail pipe 28 has been explained in the present embodiment as being expanded in diameter, the upstream portion 28A of the tail pipe 28 may be expanded in diameter, or otherwise both of the upstream portion 28A and the downstream portion 28C of the tail pipe 28 may be expanded in diameter.

(Sixth Embodiment)

Figure 27:
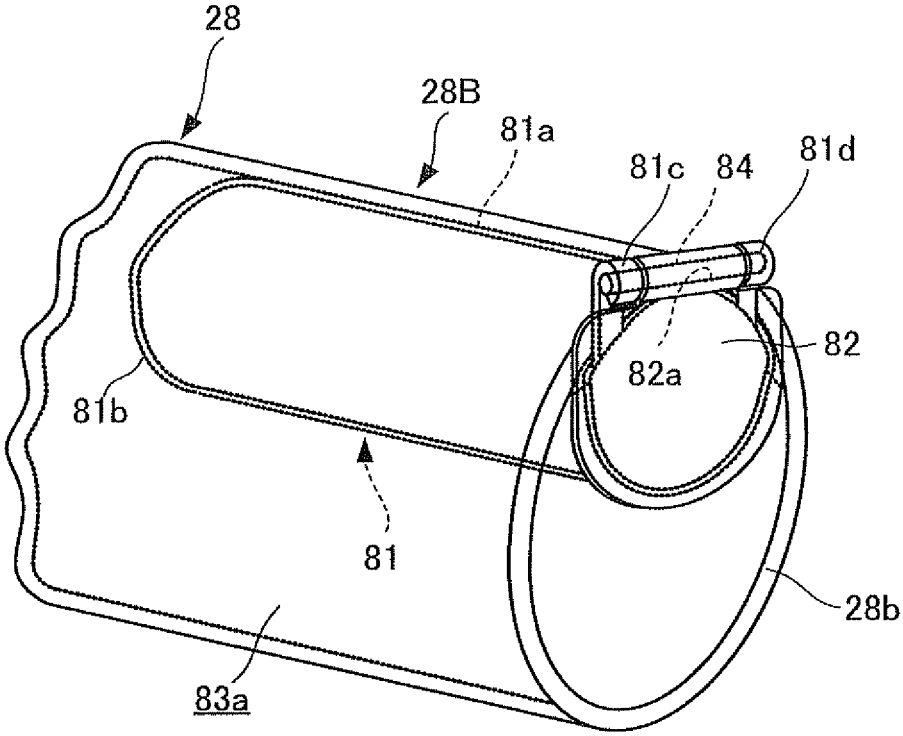
FIG. 27 is a view showing a sixth embodiment of the exhaust pipe part and the exhaust apparatus for the internal combustion engine according to the present invention, and a perspective view partly showing the downstream portion of the tail pipe.
Figure 28:
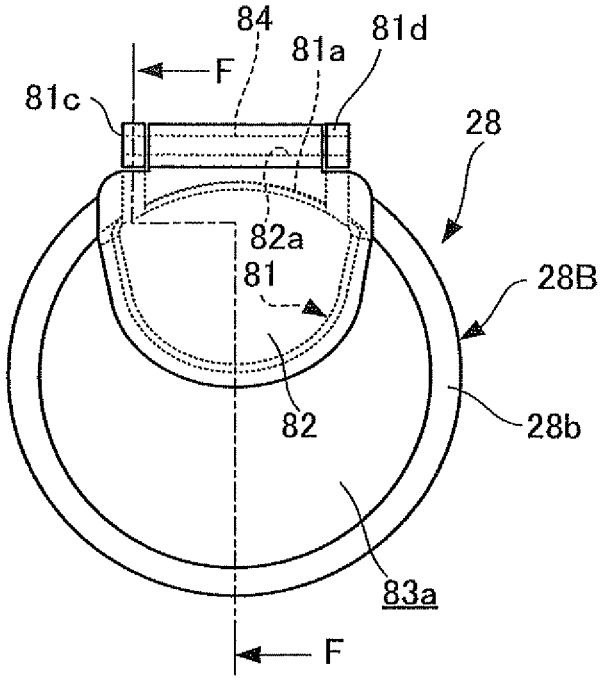
FIG. 28 is a view showing the sixth embodiment of the exhaust pipe part and the exhaust apparatus for the internal combustion engine according to the present invention, and a front view of the tail pipe seen from the axial direction thereof.
Figure 29:
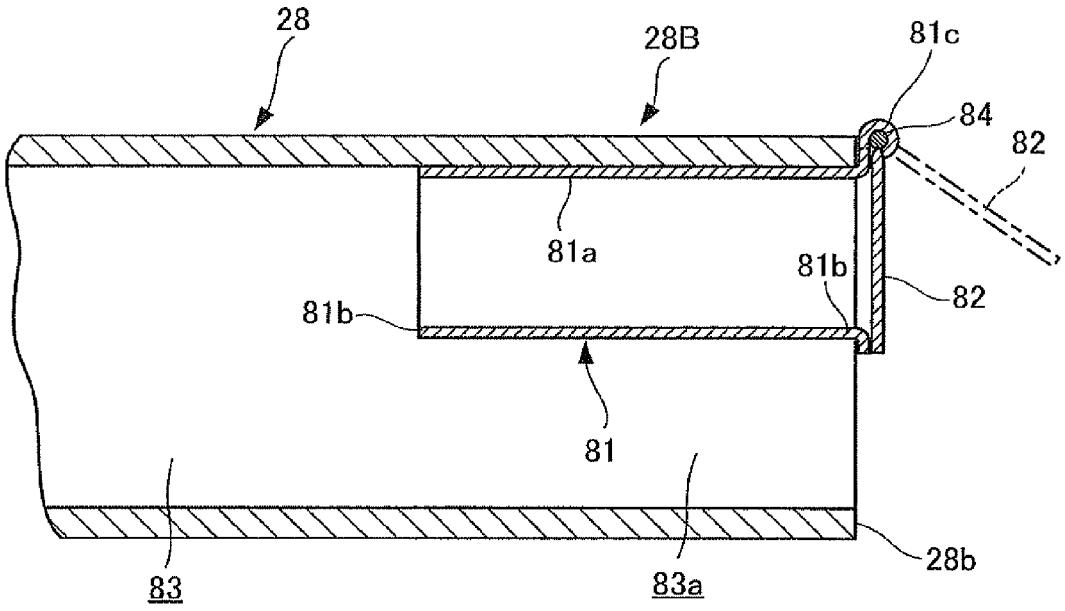
FIG. 29 is a cross-sectional view of the tail pipe taken along and seen from the line F-F of FIG. 28.

FIGS. 27 to 29 are views respectively showing sixth embodiment of the exhaust pipe part and the exhaust apparatus for the internal combustion engine according to the present invention. The constitution parts and elements forming the sixth embodiment the same as those of the first embodiment bear the same reference numerals as those of the first embodiment, and will be omitted from being explained hereinafter to avoid tedious repetition therefor.

As shown in FIGS. 27 and 29, there is provided a short pipe 81 in the inner portion of the downstream portion 28B of the tail pipe 28 with the center axis of the short pipe 81 being displaced upwardly of the center axis of the tail pipe 28. The short pipe 81 has one side surface formed with a cylindrical portion 81 a extending along the inner surface of the tail pipe 28 and secured to the inner peripheral portion of the downstream portion 28B of the tail pipe 28 by welding and other securing methods.

The short pipe 81 has at its upstream end an open end 81*b* forming an axial other end, and at its downstream end a closed end, i.e., an on-off valve 82 serving as a bottom plate forming an axial one end. The short pipe 81 is formed in a bottomed cylindrical shape extending in the axial direction of the tail pipe 28 and having a predetermined length.

The downstream portion 28B of the tail pipe 28 in the present embodiment constitutes a hollow member. The hollow member is integrally formed with the tail pipe 28 which is made of a single pipe.

Further, the downstream portion 28B of the tail pipe 28 may be constituted by a hollow member separate from the tail pipe 28, the downstream portion 28B constituted by the hollow member and the short pipe 61 collectively constituting the exhaust pipe part which is to be attached to the tail pipe 28.

The present embodiment is constructed with the on-off valve 82 of the short pipe 81 being positioned in coplanar relationship with the downstream open end 28*b*, so that the on-off valve 82 is positioned at the node portion of the standing wave in the sound pressure distribution of the air column resonance caused in the tail pipe 28.

The standing wave of the air column resonance caused in the tail pipe 28 has a wave length λ. The short pipe 81 forming part of the present embodiment is set to have a length ⅛·×λ with respect to the wave length λ of the standing wave of the air column resonance, viz., set to have a length equal to ¼ the length L of the tail pipe 28.

Further, the volume of the exhaust passage 83*a* of the downstream portion 28B of the tail pipe 28 is reduced in such a manner that the volume per unit length of the exhaust passage 83*a* of the downstream portion 28B of the tail pipe 28 is smaller than the volume per unit length of the exhaust passage 83 of the tail pipe 28.

More specifically, the short pipe 81 is set to give rise to a reduction amount more than or equal to 2.5% of the volume of the exhaust passage 83 of the tail pipe 28 when the short pipe 81 is provided in the tail pipe 28 with respect to the volume of the exhaust passage 83 of the tail pipe 28 when the short pipe 81 is not provided in the tail pipe 28.

Further, the exhaust passage 83 indicates the whole space surrounded by the tail pipe 28, and the exhaust passage 83*a* is constituted by a space surrounded by the outer peripheral portion of the short pipe 81 and the inner peripheral portion of the downstream portion 28B of the tail pipe 28 in the exhaust passage 83.

On the other hand, the short pipe 81 has at its downstream end a pair of projections 81*c*, 81*d* projecting upwardly from the widthwise both end portions of the short pipe 81 in spaced-apart relationship with each other. The projections 81*c*, 81*d* have a shaft member 84 secured thereto and supported thereon, the shaft member 84 being received in a through bore 82*a* formed on the upper portion of the on-off valve 82.

The on-off valve 82 is swingably supported on the shaft member 84. The on-off valve 82 is operated to open the short pipe 81 as shown in phantom lines in FIG. 29 when the flow amount of the exhaust gas flowing in the short pipe 81 is increased over a predetermined flow amount (exemplified by a flow amount at the time of the engine being operated at a high rotation speed) to have the on-off valve 82 receive the flow of the exhaust gas, and to close the short pipe 81 as shown in solid lines in FIG. 29 when the flow amount of the exhaust gas flowing in the short pipe 81 is decreased below the predetermined flow amount. It is thus to be noted that the on-off valve 82 constitutes a bottom plate, i.e., a closed end of the short pipe 81.

The tail pipe 28 having the short pipe 81 thus constructed has therein a potential energy A which is distributed into a potential energy A1 in the short pipe 81 and a potential energy A2 in the tail pipe 28 with no short pipe 81, so that only the potential energy A2 with no short pipe 81 is discharged to the outside, thereby making it possible to reduce the peak of the sound pressure as well as to lower the sound pressure level.

The tail pipe 28 is lengthened in a pseudo form to have the frequency of the air column resonance of the tail pipe 28 lowered to the frequency of the air column resonance equal to the frequency of the air column resonance caused in the tail pipe 28 long in length. Moreover, the potential energy can be distributed in the whole of the tail pipe 28 by the lengthened portion of the tail pipe 28, thereby making it possible for the inner diameter of the tail pipe 28 to be made small in the pseudo form. For this reason, it is possible to additionally lower the peak of the sound pressure of the air column resonance and additionally reduce the sound pressure level of the air column resonance.

As a consequence, the sixth embodiment of the present invention can reduce the exhaust noises in the same manner as that of the first embodiment and can make unnecessary the muffler used in the conventional vehicle, and make the muffler 27 small in size. Moreover, the sixth embodiment of the present invention not only can reduce the weight of the exhaust apparatus 23 but also can decrease the production cost of the exhaust apparatus 23.

As will be understood from the foregoing description, the present embodiment is constructed in such a manner that the bottom plate constituting the closed end of the short pipe 81 is constituted by the on-off valve 82 to enable the on-off valve 82 to receive the flow of the exhaust gas flow and to be opened by the flow of the exhaust gas flow when the flow amount of the exhaust gas flowing in the short pipe 81 is increased over the predetermined flow amount, so that the on-off valve 82 can be closed at the low rotation speed of the engine 21 with the flow amount of the exhaust gas being relatively small. This means that the on-off valve 82 can constitute the bottom plate, thereby making it possible to accumulate the potential energy in the short pipe 81.

Further, the present embodiment can discharge the exhaust gas through the short pipe 81 by opening the on-off valve 3 82 when the flow amount of the exhaust gas is increased to a relatively high level, thereby making it possible to prevent the back pressure of the exhaust gas from being raised at the high rotation speed of the engine 21 as well as to prevent the exhaust property from being lowered.

(Seventh Embodiment)

Figure 30:
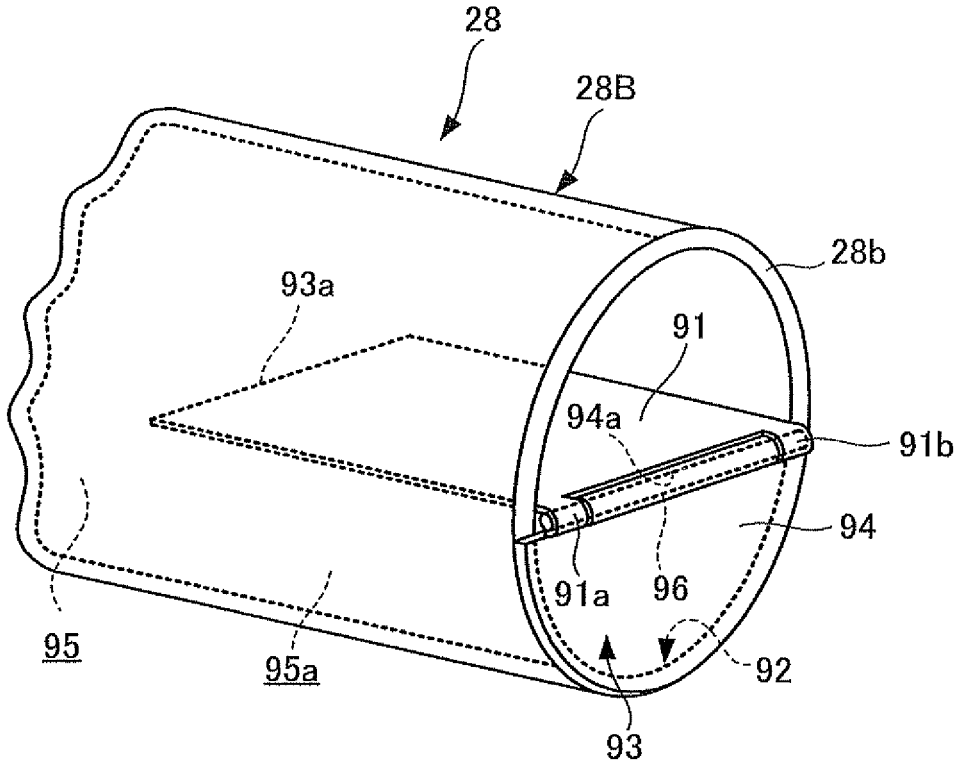
FIG. 30 is a view showing a seventh embodiment of the exhaust pipe part and the exhaust apparatus for the internal combustion engine according to the present invention, and a perspective view partly showing the downstream portion of the tail pipe.
Figure 31:
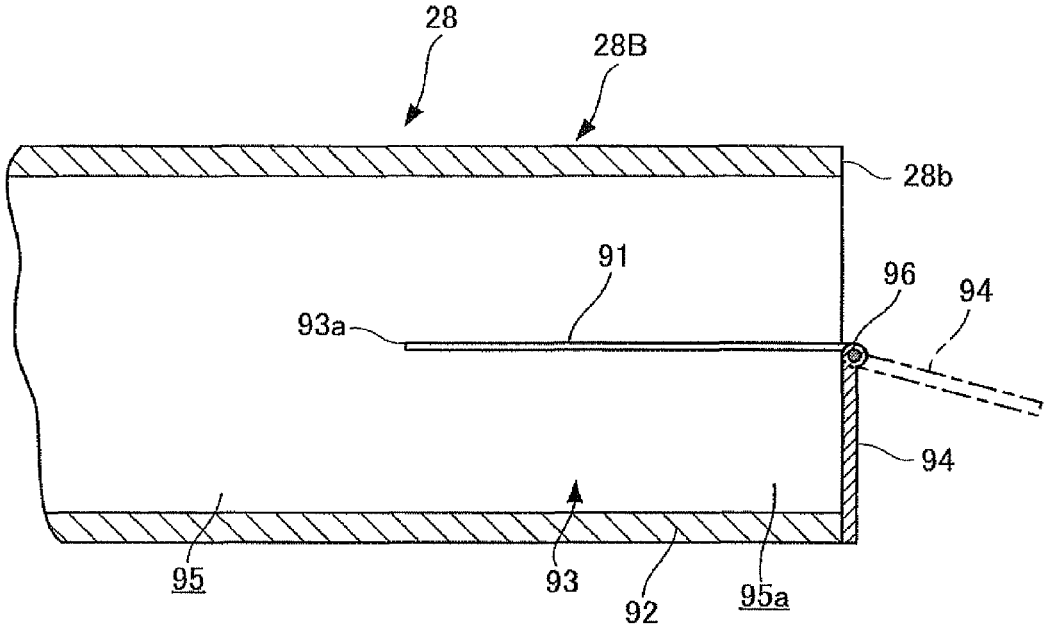
FIG. 31 is a view showing the seventh embodiment of the exhaust pipe part and the exhaust apparatus for the internal combustion engine according to the present invention, and a cross-sectional view of the downstream portion of the tail pipe.
Figure 32:
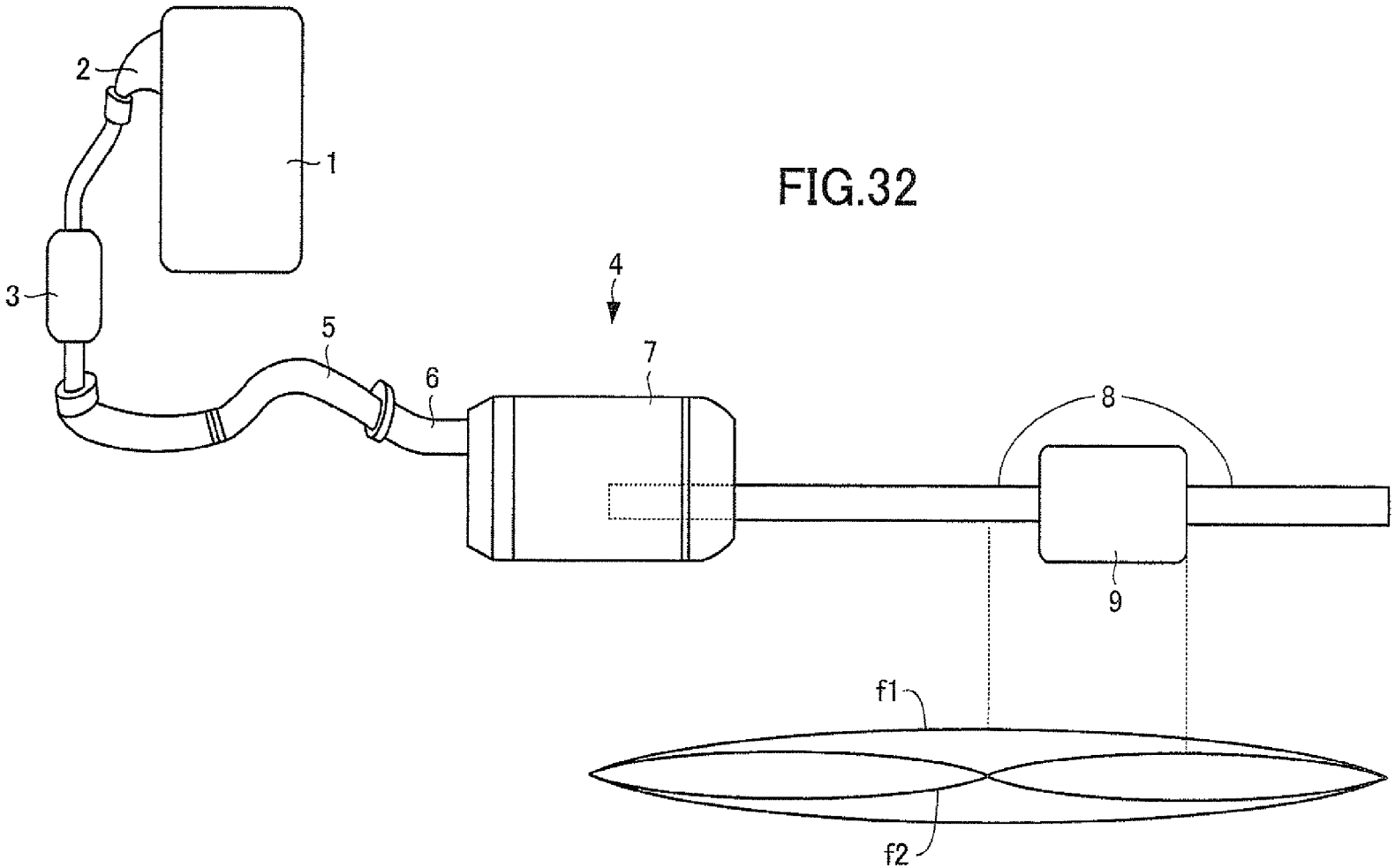
FIG. 32 is a constitution view of a conventional exhaust apparatus for an internal combustion engine.
Figure 33:
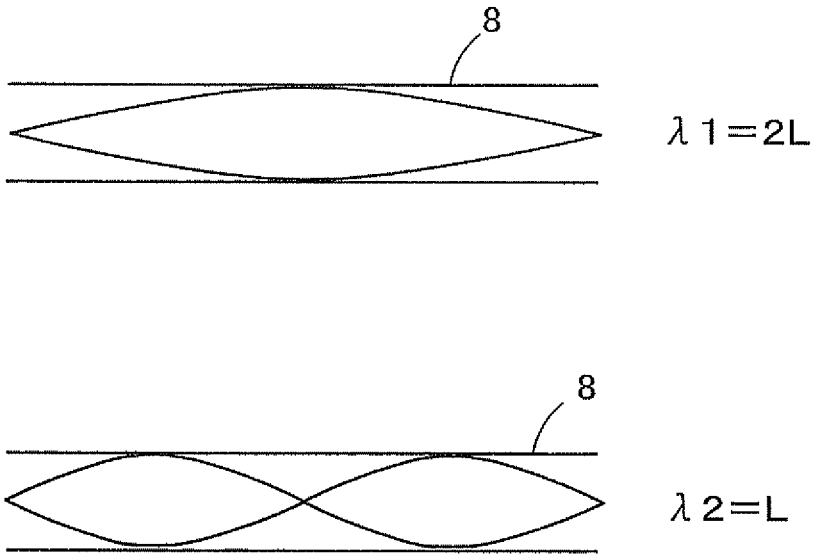
FIG. 33 is a view for explaining standing waves of particle speed distribution of air column resonance generated by an open end reflection in the tail pipe.
Figure 34:
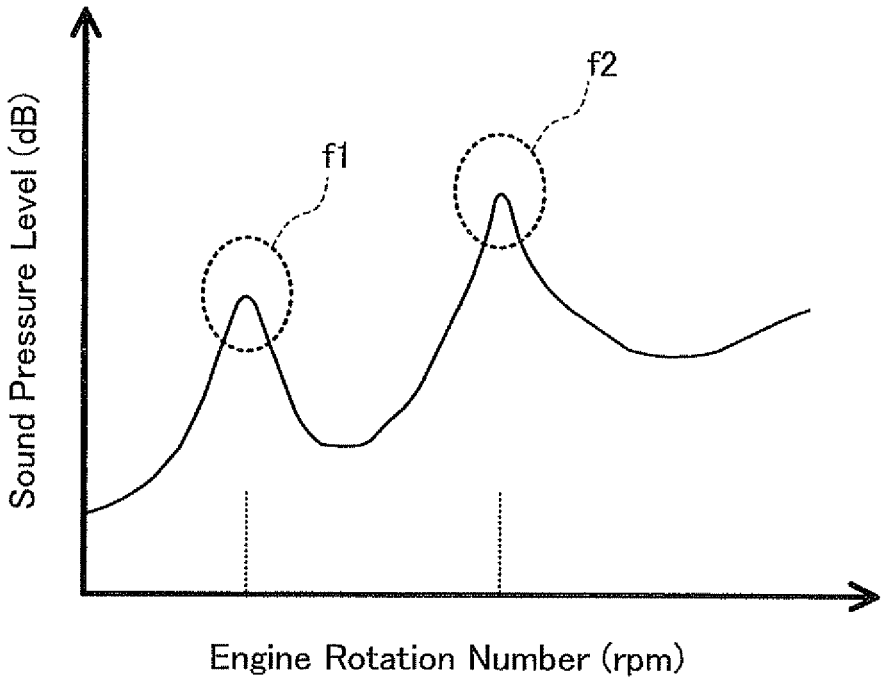
FIG. 34 is a view showing the relationship between the sound pressure level generated in the conventional tail pipe and the engine rotation number.

FIGS. 30 to 31 are views respectively showing a seventh embodiment of the exhaust pipe part and the exhaust apparatus for the internal combustion engine according to the present invention. The constitution parts and elements forming the seventh embodiment the same as those of the first embodiment bear the same reference numerals as those of the first embodiment, and will be omitted from being explained hereinafter to avoid tedious repetition therefor.

As shown in FIGS. 30 and 31, there is provided a partition plate 91 in the downstream portion 28B of the tail pipe 28. The partition plate 91 is secured to the downstream portion 28B of the tail pipe 28 in such a manner that the center axis of the partition plate 91 is on the center axis of the tail pipe 28, so that the exhaust passage of the downstream portion 28B is divided into two upper and lower halves. It will thus be understood from the foregoing description that the short pipe 93 is constituted by the partition plate 91 and the lower half (hereinafter referred to as "half round portion 92") of the downstream portion 28B of the tail pipe 28 which is positioned below the partition plate 91.

The present embodiment is constructed with the short pipe 93 having at its axial other end an open end 93*a* and at its axial one end a closed end i.e., an on-off valve 94 constituting the bottom plate, the axial center axis of the short pipe 93 being displaced downwardly of the axial center axis of the tail pipe 28. The on-off valve 94 of the short pipe 93 is positioned in coplanar relationship with the downstream open end 28*b*, so that the on-off valve 94 of the short pipe 93 is positioned at the node portion of the standing wave in the sound pressure distribution of the air column resonance caused in the tail pipe 28.

The downstream portion 28B of the tail pipe 28 in the present embodiment constitutes a hollow member. The hollow member is integrally formed with the tail pipe 28 which is made of a single pipe.

Further, the downstream portion 28B of the tail pipe 28 may be constituted by a hollow member separate from the tail pipe 28, the downstream portion 28B constituted by the hollow member and the short pipe 61 collectively constituting the exhaust pipe part which is to be attached to the tail pipe 28.

The standing wave of the air column resonance caused in the tail pipe 28 has a wave length λ. The short pipe 93 forming part of the present embodiment is set to have a length ⅛·×λ with respect to the wave length λ of the standing wave of the air column resonance, viz., set to have a length equal to ¼ the length L of the tail pipe 28.

Further, the volume of the exhaust passage 95*a* of the downstream portion 28B of the tail pipe 28 is reduced in such a manner that the volume per unit length of the exhaust passage 95*a* of the downstream portion 28B of the tail pipe 28 is smaller than the volume per unit length of the exhaust passage 95 of the tail pipe 28.

More specifically, the short pipe 93 has a size set in such a manner that the reduction amount of the volume of the exhaust passage 95 of the tail pipe 28 when the short pipe 93 is provided in the tail pipe 28 with respect to the volume of the exhaust passage 95 of the tail pipe 28 when the short pipe 93 is not provided in the tail pipe 28 is more than or equal to 2.5% of the volume of the exhaust passage 95 of the tail pipe 28 when the short pipe 93 is not provided in the tail pipe 28.

Further, the exhaust passage 95 indicates the whole space surrounded by the tail pipe 28, and the exhaust passage 95 is constituted by a space surrounded by the partition plate 91 and the inner peripheral portion of the half round portion 92.

On the other hand, the partition plate 91 has at its downstream end a pair of projections 91*a*, 91*b* projecting upwardly from the widthwise both end portions of the partition plate 91 in spaced-apart relationship with each other. The projections 91*a*, 91*b* have a shaft member 96 secured thereto and supported thereon, the shaft member 96 being received in a through bore 94*a* formed on the upper portion of the on-off valve 94.

The on-off valve 94 is swingably supported on the shaft member 96. The on-off valve 94 is operated to open the short pipe 93 as shown in phantom lines in FIG. 31 when the flow amount of the exhaust gas flowing in the short pipe 93 is increased over a predetermined flow amount (exemplified by a flow amount at the time of the engine being operated at a high rotation speed) to have the on-off valve 94 receive the flow of the exhaust gas, and to close the short pipe 93 as shown in solid lines in FIG. 31 when the flow amount of the exhaust gas flowing in the short pipe 93 is decreased below the predetermined flow amount. It is thus to be noted that the on-off valve 94 constitutes a bottom plate, i.e., a closed end of the short pipe 93.

The tail pipe 28 having the short pipe 93 thus constructed has therein a potential energy A which is distributed into a potential energy A1 in the short pipe 93 and a potential energy A2 in the tail pipe 28 with no short pipe 93, so that only the potential energy A2 with no short pipe 93 is discharged to the outside, thereby making it possible to reduce the peak of the sound pressure as well as to lower the sound pressure level.

The tail pipe 28 is lengthened in a pseudo form to have the frequency of the air column resonance of the tail pipe 28 lowered to the frequency of the air column resonance equal to the frequency of the air column resonance caused in the tail pipe 28 long in length. Moreover, the potential energy can be distributed in the whole of the tail pipe 28 by the lengthened portion of the tail pipe 28, thereby making it possible for the inner diameter of the tail pipe 28 to be made small in the pseudo form. For this reason, it is possible to additionally lower the peak of the sound pressure of the air column resonance and additionally reduce the sound pressure level of the air column resonance. The seventh embodiment can attain the same effects as those of the first embodiment.

As a consequence, the seventh embodiment of the present invention can reduce the exhaust noises in the same manner as that of the first embodiment and can make unnecessary the muffler used in the conventional vehicle, and make the muffler 27 small in size. Moreover, the seventh embodiment of the present invention not only can reduce the weight of the exhaust apparatus 23 but also can decrease the production cost of the exhaust apparatus 23.

As will be understood from the foregoing description, the present embodiment is constructed in such a manner that the bottom plate constituting the closed end of the short pipe 93 is constituted by the on-off valve 94 to enable the on-off valve 94 to receive the flow of the exhaust gas flow and to be opened by the flow of the exhaust gas flow when the flow amount of the exhaust gas flowing in the short pipe 93 is increased over the predetermined flow amount, so that the on-off valve 94 can be closed at the low rotation speed of the engine 21 with the flow amount of the exhaust gas being relatively small. This means that the on-off valve 94 can constitute the bottom plate, thereby making it possible to accumulate potential energy in the short pipe 93.

Further, the present embodiment is constructed in such a manner that when the flow amount of the exhaust gas is increased over the predetermined level, the on-off valve 94 is opened to enable the exhaust gas to be discharged to the outside through the short pipe 93, thereby making it possible to prevent the back pressure of the exhaust gas from being raised at the high rotation speed of the engine 21 as well as to prevent the exhaust property from being lowered.

In addition, the present embodiment is constructed in such a manner that in lieu of the short pipe, i.e., a single part to be attached to the tail pipe 28, the short pipe 93 is partly constituted by the half round portion 92 which is part of the downstream portion 28B of the tail pipe 28, thereby making it possible to reduce the weight of the tail pipe 28.

Although there has been explained about the above embodiments in which the short pipes 43, 46, 61, 65, 71, 75, 81, 93 have been provided on at least any one of the upstream portion 28A and the downstream portion 28B, it may be possible to provide an additional short pipe at the node portion of the sound pressure distribution having the secondary component f2 of the air column resonance.

In this case, the additional short pipe is set to have a length less than or equal to the length ⅛·×λ with respect to the wave length λ of the standing wave of the air column resonance. The wave length λ2 of the secondary component f2 is equal to L, viz., λ2=L, so that it may be possible to set the length of the short pipe at the length less than or equal to ⅛·the length L of the tail pipe 28, and to have the upstream end and the downstream end of the short pipe disposed at the node portion of the sound pressure distribution.

The previously mentioned embodiments have been raised as examples to explain the present invention, however, the present invention is not limited to these embodiments. The scope of the present invention should be construed based on the claims but not on these embodiments. It is needless to say that the equivalents and modifications of the elements or parts defined in claims should be incorporated within the scope of the present invention.

As previously mentioned, the exhaust pipe part and the exhaust apparatus for the internal combustion engine according to the present invention can make unnecessary the muffler used in the conventional vehicle, and make small in size the muffler provided on the one end portion of the exhaust pipe, thereby making it possible to reduce the noises of the exhaust gas. Moreover, the present invention not only can reduce the weight of the exhaust apparatus but also can decrease the production cost of the exhaust apparatus. The present invention is useful as an exhaust pipe part and an exhaust apparatus for an internal combustion engine which are designed to reduce the noises of the exhaust gas caused by the air column resonance of an exhaust pipe provided at the downstream end in the exhaust direction of the exhaust gas.

(Explanation of Reference Numerals)

| | |
|---|---|
| 21: | engine (internal combustion engine) |
| 23: | exhaust apparatus |
| 27: | muffler (sound deadening device) |
| 28: | tail pipe (exhaust pipe) |
| 28A: | upstream portion (one end portion) |
| 28B, 28C: | downstream portion (other end portion) |
| 28a: | upstream open end |
| 28b, 28c: | downstream open end |
| 41: | exhaust pipe part |
| 42b: | downstream open end (axial one end) |
| 43, 46: | short pipe |
| 43a: | open end |
| 43b: | bottom plate (closed end) |
| 45, 45a: | exhaust passage |
| 45a: | exhaust passage |
| 61: | short pipe |
| 61a: | bottom plate (closed end) |
| 61b: | annular member |
| 62, 62a: | exhaust passage |
| 65: | short pipe |
| 65a: | open end |
| 65b: | bottom plate (closed end) |
| 67, 67a: | exhaust passage |
| 71: | short pipe |
| 71a: | open end |
| 71b: | bottom plate (closed end) |
| 73, 73a: | exhaust passage |
| 75: | short pipe |
| 75a: | open end |
| 75b: | bottom plate (closed end) |
| 77, 77a: | exhaust passage |
| 81: | short pipe |
| 82: | on-off valve (bottom plate, closed end) |
| 83, 83a: | exhaust passage |
| 91: | partition plate |
| 93: | short pipe |
| 93a: | open end |
| 94: | on-off valve (bottom plate, closed end) |
| 95, 95a: | exhaust passage |

The invention claimed is:

1. An exhaust pipe part to be attached to an exhaust pipe and constituting part of the exhaust pipe, the exhaust pipe having at one end portion an upstream open end connected with a sound deadening device positioned at an upstream side of exhaust gas discharged from an internal combustion engine, and at the other end portion a downstream open end to allow the exhaust gas discharged to the atmosphere, comprising:

a hollow member to be connected with the exhaust pipe in axial alignment with the exhaust pipe to be positioned within an area covering a node portion in a sound pressure distribution of an air column resonance caused in the exhaust pipe, and a short pipe provided in the hollow member and having a predetermined length to extend in the axial direction of the exhaust pipe, the short pipe having a closed end at an axial one end thereof and an open end at the axial other end thereof, the closed end being positioned at almost the same position as that of the node portion in the sound pressure distribution of a standing wave formed by the air column resonance caused in the exhaust pipe, the standing wave of the air column resonance having a wave length $\lambda$, and the short pipe being set to have a length less than or equal to $\frac{1}{8}\lambda$.

2. The exhaust pipe part as set forth in claim 1, in which the short pipe and the hollow member form therebetween an exhaust passage throttled in such a manner that the volume per unit length of the exhaust passage between the short pipe and the hollow member is smaller than the volume per unit length of the exhaust passage of the exhaust pipe.

3. The exhaust pipe part as set forth in claim 1, in which the hollow member has an inner diameter almost the same as the inner diameter of the exhaust pipe.

4. The exhaust pipe part as set forth in any one of claim 1, in which the hollow member is provided on at least one of the one end portion and the other end portion of the exhaust pipe to have the axial one end of the hollow member constitute at least one of the upstream open end and the downstream open end of the exhaust pipe.

5. The exhaust pipe part as set forth in claim 1, in which the short pipe has a size set in such a manner that the volume of the exhaust passage of the exhaust pipe and the hollow member having the short pipe is reduced by a volume reduction amount from the whole volume of the exhaust passage of the exhaust pipe and the hollow member having no short pipe, the volume reduction amount being no less than 2.5%.

6. The exhaust pipe part as set forth in claim 1, in which the short pipe has a closed end formed by being bent from the axial one end of the hollow member toward the center axis of the exhaust pipe, and an annular member bent from the closed end of the short pipe toward the axial other end of the hollow member to extend in parallel with the hollow member.

7. The exhaust pipe part as set forth in claim 1, in which the hollow member is provided at the one end portion of the exhaust pipe, the short pipe having cross-sectional areas at the axial one end thereof and at the axial other end thereof, and the cross-sectional area of the short pipe at the axial one end thereof being smaller the cross-sectional area of the short pipe at the axial other end thereof.

8. The exhaust pipe part as set forth in claim 1, in which the hollow member is provided at the other end portion of the exhaust pipe, the short pipe having cross-sectional areas at the axial one end thereof and at the axial other end thereof, and the cross-sectional area of the short pipe at the axial one end thereof being smaller than the cross-sectional area of the short pipe at the axial other end thereof.

9. The exhaust pipe part as set forth in claim 1, in which the short plate has a bottom plate forming the closed end and constituted by an on-off valve, the on-off valve being opened when the flow amount of the exhaust gas flowing in the short pipe is over a predetermined flow amount.

10. The exhaust pipe part as set forth in claim 1, in which the inner diameter of the hollow member is expanded to be larger than the inner diameter of the exhaust pipe.

11. An exhaust apparatus of an internal combustion engine provided with an exhaust pipe having at one end portion an upstream open end connected with a sound deadening device positioned at an upstream side of exhaust gas discharged from an internal combustion engine, and at the other end portion a downstream open end to allow the exhaust gas to be discharged to the atmosphere, the exhaust pipe having an exhaust pipe part as set forth in claim 1.

12. The exhaust apparatus of the internal combustion engine as set forth in claim 11, in which the hollow member is integrally formed with the exhaust pipe.

13. An exhaust pipe part to be attached to an exhaust pipe and constituting part of the exhaust pipe, the exhaust pipe having at one end portion an upstream open end connected with a sound deadening device positioned at an upstream side of exhaust gas discharged from an internal combustion engine, and at the other end portion a downstream open end to allow the exhaust gas discharged to the atmosphere, comprising:

a hollow member to be connected with the exhaust pipe in axial alignment with the exhaust pipe to be positioned within an area covering a node portion in a sound pressure distribution of an air column resonance caused in the exhaust pipe, and a short pipe provided in the hollow member and having a predetermined length to extend in the axial direction of the exhaust pipe, the short pipe having a closed end at an axial one end thereof and an open end at the axial other end thereof, the closed end being positioned at almost the same position as that of the node portion in the sound pressure distribution of a standing wave formed by the air column resonance caused in the exhaust pipe, the short pipe having a length less than or equal to ¼ the length of the exhaust pipe.

* * * * *